US011796955B2

(12) United States Patent
Monden et al.

(10) Patent No.: US 11,796,955 B2
(45) Date of Patent: Oct. 24, 2023

(54) PROCESSING APPARATUS AND IMAGE FORMING SYSTEM WITH ROTATING PUNCH THAT PUNCHES SHEET AT PUNCHING POSITION

(71) Applicant: CANON KABUSHIKI KAISHA, Tokyo (JP)

(72) Inventors: Noriyuki Monden, Shizuoka (JP); Takahiro Endo, Shizuoka (JP); Yasuhiro Nakahara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/678,188

(22) Filed: Feb. 23, 2022

(65) Prior Publication Data

US 2022/0283534 A1 Sep. 8, 2022

(30) Foreign Application Priority Data

Mar. 2, 2021 (JP) ..... 2021-032296

(51) Int. Cl.
*G03G 15/00* (2006.01)

(52) U.S. Cl.
CPC ..... *G03G 15/6582* (2013.01); *G03G 15/5008* (2013.01); *G03G 2215/00818* (2013.01)

(58) Field of Classification Search
CPC ..... G03G 15/6582; G03G 2215/00949
See application file for complete search history.

(56) References Cited

U.S. PATENT DOCUMENTS

| | | | | |
|---|---|---|---|---|
| 6,381,443 | B1 * | 4/2002 | Kawata | G03G 15/6582 399/407 |
| 6,672,504 | B1 * | 1/2004 | Ueda | G03G 15/6582 83/687 |
| 7,090,120 | B2 * | 8/2006 | Ueda | B26F 1/04 83/687 |
| 8,401,412 | B2 * | 3/2013 | Mikutsu | G03G 15/2028 399/68 |
| 10,071,494 | B2 * | 9/2018 | Pantonial | B26D 5/086 |
| 11,086,261 | B2 | 8/2021 | Endo | |
| 11,215,946 | B2 | 1/2022 | Koyama et al. | |
| 11,279,586 | B2 | 3/2022 | Nakahara | |

(Continued)

FOREIGN PATENT DOCUMENTS

| | | | |
|---|---|---|---|
| JP | H10-194577 | A | 7/1998 |
| JP | 2008-173734 | A | 7/2008 |
| JP | 2009-102083 | A | 5/2009 |

*Primary Examiner* — Arlene Heredia
(74) *Attorney, Agent, or Firm* — Venable LLP

(57) ABSTRACT

A processing apparatus processing on a sheet includes a punch unit configured to punch a sheet at a punching position while rotating, a first motor configured to drive the punch unit, a first rotary member disposed upstream of the punch unit in a conveyance direction of the sheet and configured to convey the sheet, a second motor configured to drive the first rotary member, a control unit configured to control driving of the first motor and the second motor, and a first detection unit configured to detect a surface speed of the first rotary member. The control unit is configured to adjust a rotation speed of the second motor so that a surface speed of the first rotary member obtained based on a detection result of the first detection unit substantially matches a tangential component of a rotation speed of the punch unit at the punching position.

13 Claims, 11 Drawing Sheets

(56) References Cited

U.S. PATENT DOCUMENTS

| | | | | |
|---|---|---|---|---|
| 2006/0191989 | A1* | 8/2006 | Ueda | G03G 15/6582 234/50 |
| 2021/0284480 | A1 | 9/2021 | Endo | |
| 2021/0325809 | A1 | 10/2021 | Endo | |
| 2022/0082981 | A1 | 3/2022 | Koyama et al. | |
| 2022/0146977 | A1* | 5/2022 | Monden | B26D 5/06 |

* cited by examiner

PROCESSING APPARATUS AND IMAGE FORMING SYSTEM WITH ROTATING PUNCH THAT PUNCHES SHEET AT PUNCHING POSITION

BACKGROUND OF THE INVENTION

Field of the Invention

The present invention relates to a processing apparatus and an image forming system. For example, the present invention relates to a processing apparatus including a punching device that punches binding holes in a sheet on which an image is formed by an image forming apparatus such as a copier or a printer.

Description of the Related Art

Typically, a post-processing apparatus having a rotary punch has been proposed. For example, there has been proposed a technique related to a punch unit that conveys a sheet to a punch unit by a conveying roller disposed on a conveyance path, and rotationally drives the punch to punch the sheet at a predetermined position while conveying the sheet (See, for example, U.S. patent Ser. No. 10/071,494). In addition, it is common to use a rubber roller for the conveying roller to apply a transfer force to a sheet.

However, in the rubber roller, a diameter of the roller deviates from an ideal diameter due to scraping of a surface due to wear, variation in component tolerance, thermal expansion, and the like. There is a risk that a conveyance speed of the sheet changes due to the deviation in the diameter of the roller, and a punching position (position of a first hole, an interval between the holes, and the like) with respect to the sheet deviates.

SUMMARY OF THE INVENTION

According to a first aspect of the present invention is a processing apparatus processing on a sheet, including a punch unit configured to punch a sheet being conveyed at a punching position while rotating, a first motor configured to drive the punch unit, a first rotary member disposed upstream of the punch unit in a conveyance direction of the sheet and configured to convey the sheet, a second motor configured to drive the first rotary member, a control unit configured to control driving of the first motor and the second motor, and a first detection unit configured to detect a surface speed of the first rotary member. The control unit is configured to adjust a rotation speed of the second motor so that a surface speed of the first rotary member obtained based on a detection result of the first detection unit substantially matches a tangential component of a rotation speed of the punch unit at the punching position.

According to a second aspect of the present invention is a processing apparatus processing on a sheet, including a punch unit configured to punch a sheet being conveyed at a punching position while rotating, a first motor configured to drive the punch unit, a first rotary member disposed upstream of the punch unit in a conveyance direction of the sheet and configured to convey the sheet, a second motor configured to drive the first rotary member, a control unit configured to control driving of the first motor and the second motor, and a first detection unit configured to detect a surface speed of the first rotary member. The control unit is configured to adjust timing at which the driving of the first motor is started and a rotation speed of the first motor between a predetermined punching operation and a punching operation performed following the predetermined punching operation based on the surface speed of the first rotary member obtained based on a detection result of the first detection unit.

According to a third aspect of the present invention is an image forming system, including an image forming unit configured to form an image on a sheet, a punch unit configured to punch a sheet on which an image is formed by the image forming unit at a punching position while rotating with respect to the sheet, a first motor configured to drive the punch unit, a first rotary member disposed upstream of the punch unit in a conveyance direction of the sheet and configured to convey the sheet, a second motor configured to drive the first rotary member, a control unit configured to control driving of the first motor and the second motor, and a first detection unit configured to detect a surface speed of the first rotary member. The control unit is configured to adjust a rotation speed of the second motor so that a surface speed of the first rotary member obtained based on a detection result of the first detection unit substantially matches a tangential component of a rotation speed of the punch unit at the punching position.

According to a fourth aspect of the present invention is an image forming system, including an image forming unit configured to form an image on a sheet, a punch unit configured to punch a sheet on which an image is formed by the image forming unit at a punching position while rotating with respect to the sheet, a first motor configured to drive the punch unit, a first rotary member disposed upstream of the punch unit in a conveyance direction of the sheet and configured to convey the sheet, a second motor configured to drive the first rotary member, a control unit configured to control driving of the first motor and the second motor, and a first detection unit configured to detect a surface speed of the first rotary member. The control unit is configured to adjust timing at which the driving of the first motor is started and a rotation speed of the first motor between a predetermined punching operation and a punching operation performed following the predetermined punching operation based on the surface speed of the first rotary member obtained based on a detection result of the first detection unit.

According to a fifth aspect of the present invention is a processing apparatus processing on a sheet, including a sheet processing unit configured to perform processing on a sheet, a first rotary member disposed upstream of the sheet processing unit in a conveyance direction of the sheet and configured to convey the sheet to the sheet processing unit, a motor configured to drive the first rotary member, a third rotary member configured to be in contact with the first rotary member and rotate the first rotary member and have a Young's modulus than that of the first rotary member, and a first detection unit configured to detect a rotation cycle of the third rotary member.

Further features of the present invention will become apparent from the following description of exemplary embodiments with reference to the attached drawings.

DESCRIPTION OF THE EMBODIMENTS

Hereinafter, preferred embodiments of the present invention will be described in detail with reference to the accompanying drawings.

First Embodiment

Figure 1:
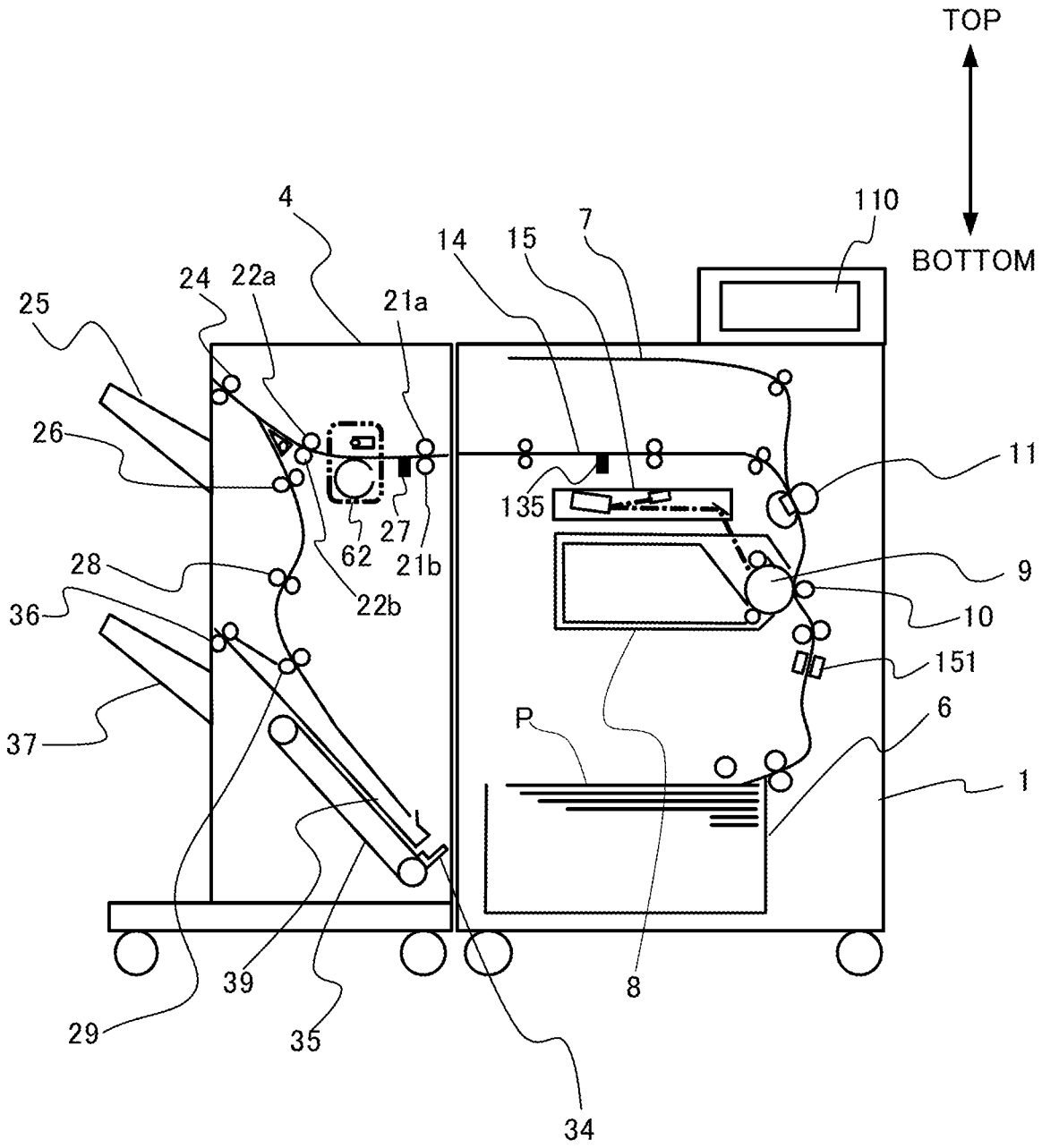
FIG. 1 is a configuration diagram of a post-processing apparatus and an image forming apparatus of first to third embodiments.

Description of Configurations of Post-Processing Apparatus and Image Forming Apparatus FIG. 1 is a cross-sectional view illustrating configurations of an electrophotographic image forming apparatus 1 and a post-processing apparatus 4 which are an image forming system of a first embodiment. In FIG. 1, a vertical direction is indicated by a double-headed arrow. The post-processing apparatus 4 performs various types of post-processing such as punching processing or stapling processing on a sheet P on which an image is formed by the image forming apparatus 1. In the present embodiment, the post-processing apparatus 4 is a processing apparatus that performs processing on a sheet. The image forming apparatus 1 includes a sheet feeding device 6 that accommodates a plurality of sheets P and feeds the sheets P one by one. The sheet type (thin paper, plain paper, thick paper, basis weight, and the like) of the sheet P fed from the sheet feeding device 6 is determined by a sheet type sensor 151 disposed on a conveyance path. The sheet P is conveyed to a photosensitive drum 9 which is an image carrier rotatably supported by a cartridge 8 and a transfer roller 10 which is a transfer unit to which a predetermined voltage is applied. The photosensitive drum 9 is subjected to various processes of exposure, charging, latent image formation, and development in the cartridge 8 to form a toner image on a surface of the photosensitive drum 9. The latent image formation is performed by a laser scanner unit 15 that forms a latent image by scanning a laser beam in a direction (main scanning direction) orthogonal to a conveyance direction of the sheet P by a rotating polygon mirror and a lens.

The sheet P on which an unfixed toner image is formed is discharged to a discharge tray 7 via a fixing unit 11 that heats and pressurizes the toner on the sheet P and fixes the toner. In a case where the sheet P is discharged to the post-processing apparatus 4, the sheet P is conveyed to a horizontal conveyance unit 14 after passing through the fixing unit 11, A conveyance sensor 135 is disposed in the horizontal conveyance unit 14. The conveyance sensor 135 is a sensor for detecting presence or absence of the sheet P in the horizontal conveyance unit 14 and detecting an interval between a sheet P conveyed in advance and a succeeding sheet P conveyed succeedingly. The sheet P is transferred from the horizontal conveyance unit 14 to the post-processing apparatus 4, and is conveyed by an upstream roller pair 21 (21*a* and 21*b*) and a downstream roller pair 22 (22*a* and 22*b*) which are conveying rollers of the post-processing apparatus 4.

(Upstream Roller Pair 21 and Downstream Roller Pair 22)

The upstream roller pair 21 is disposed upstream of a punch unit 62 in the conveyance direction of the sheet P. The downstream roller pair 22 is disposed downstream of a punch unit 62 in the conveyance direction of the sheet P. The upstream roller pair 21 and the downstream roller pair 22 are each configured by two pairs of rollers having the same diameter. The two rollers refer to a roller (driving roller) driven by a conveying motor 104 (FIG. 2) to be described later via a gear (not illustrated), and a roller (driven roller) driven in contact with the roller. Hereinafter, reference numeral of the roller to be driven is denoted by a, and reference numeral of the roller to be driven by the conveying motor 104 is denoted by b.

That is, in the present embodiment, the upstream roller pair 21 includes a driving roller 21*b* as a first rotary member, and a driven roller 21*a* as a third rotary member that is in contact with the driving roller 21*b* and is driven to rotate. As will be described in detail later, the upstream roller 21*b* on the driving side has a Young's modulus lower than that of the upstream roller 21*a* on the driven side, and is likely to be worn. In other words, the upstream roller 21*a* on the driven side is configured to have a higher Young's modulus than the upstream roller 21*b* on the drive side, and is less likely to be worn. In addition, similarly, the downstream roller pair 22 also includes the driving roller 22*b* as a second rotary member and a driven roller 22*a* as a fourth rotary member that is driven to rotate in contact with the driving roller 22*b*. The downstream roller 22*b* on the driving side is configured to have a Young's modulus lower than that of the downstream roller 22*a* on the driven side, and is likely to be worn. In other words, the downstream roller 22*a* on the driven side is configured to have a higher Young's modulus than the downstream roller 22*b* on the drive side, and is less likely to be worn. It is assumed that the upstream roller pair 21 and the downstream roller pair 22 rotate at the same speed by transmission of driving via a belt.

An inlet sensor 27 that detects the presence or absence of the sheet P and a rotary punch unit 62 are disposed between the upstream roller pair 21 and the downstream roller pair 22. In the present embodiment, the punch unit 62 is a sheet processing unit that performs processing on a sheet. The inlet sensor 27, which is a second detection unit, detects a leading edge of the sheet P, and after a predetermined time has elapsed from the timing at which the leading edge of the sheet P is detected, the punch unit 62 is rotationally driven to perform punching while the sheet P is being conveyed. The punching operation of the punch unit 62 will be described in detail in <Sheet Conveyance Control and Punching Control of Punch unit>

After being punched by the punch unit 62, the sheet P is conveyed by the downstream roller pair 22 and a roller pair 24 rotated by a drive source (not illustrated) and is discharged to an upper tray 25. In addition to the upper tray 25, a lower tray 37 is also disposed in the post-processing apparatus 4, and includes a plurality of trays as discharge destinations of the sheet P. It is assumed that the two trays ascend and descend according to a bundle amount (thickness of a bundle (hereinafter, also referred to as a sheet bundle) formed of a plurality of sheets P) of sheets P stacked on the trays by a drive source (not illustrated). In a case where the discharge destination of the sheet P is the lower tray 37, the conveyance of the sheet P is temporarily stopped before the sheet P is discharged to the upper tray 25. The sheet P is switched back by the roller pair 24 and conveyed to a roller pair 26. The sheet P is conveyed to an intermediate stacking unit 39 by the roller pair 26, a roller pair 28, and a roller pair 29 which rotates by the driving source (not illustrated). The sheets P are aligned in a conveyance direction and a width direction (direction substantially orthogonal to the conveyance direction) in the intermediate stacking unit 39, and after the alignment of a predetermined number of sheets P ends, a stapler (not illustrated) performs a binding operation. Thereafter, a discharge guide 34 connected to a guide driving unit 35 moves in parallel with a direction of the discharge roller pair 36 to push out the sheet bundle, and the sheet bundle is discharged to the lower tray 37. An operation panel 110 is operated by a user to manually set a size or type (sheet type) of the sheet P. It is assumed that the image forming apparatus 1 and the post-processing apparatus 4 are controlled based on information set using the operation panel 110. The configurations of the image forming apparatus 1 and the post-processing apparatus 4 have been described above.

Functions of Image Forming Apparatus and Post-Processing Apparatus

Figure 2:
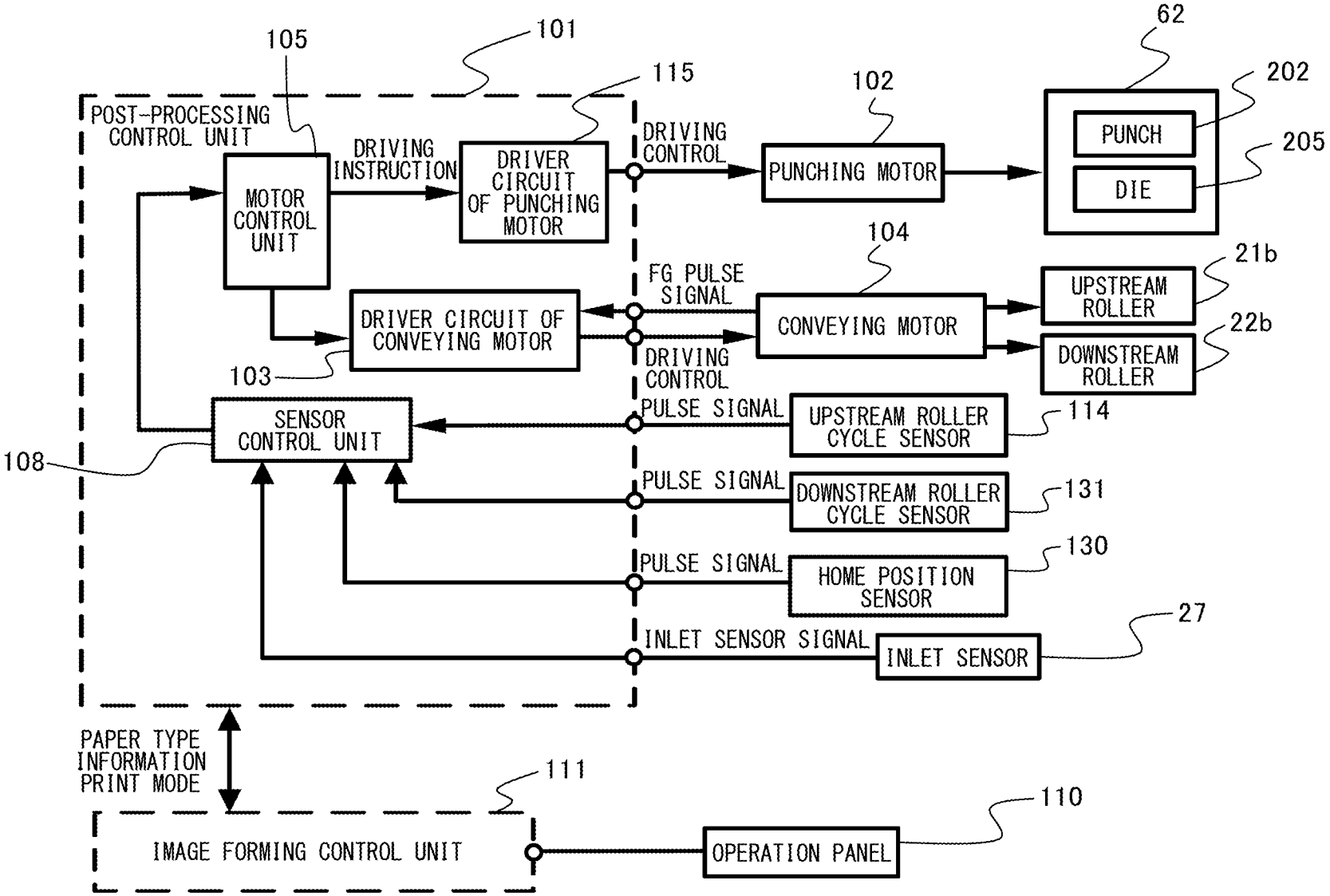
FIG. 2 is a block diagram of the post-processing apparatus and the image forming apparatus of the first to third embodiments.

FIG. 2 is a block diagram illustrating functions and configurations of the image forming apparatus 1 and the post-processing apparatus 4 illustrated in FIG. 1. Here, only portions related to the punching control and the conveyance control of the sheet P are extracted and described. An image forming control unit 111 performs image forming control of the image forming apparatus 1. The image forming control unit 111 performs an image forming operation according to sheet type information or print mode information input to the operation panel 110. In addition, the image forming control unit 111 transmits the obtained sheet type information, print mode information, and the like to the post-processing control unit 101. A post-processing control unit 101 as the control unit controls a punching operation and a conveyance operation of the post-processing apparatus 4. The post-processing control unit 101 controls the punching operation or the conveyance operation according to the sheet type information, the print mode information, and the like transmitted from the image forming control unit 111.

The post-processing control unit 101 includes a motor control unit 105, a driver circuit 115 of a punching motor 102, a driver circuit 103 of a conveying motor 104, and a sensor control unit 108. The motor control unit 105 controls the driver circuit 115 of the punching motor 102 by outputting a driving instruction to control the driving of the punching motor 102. The motor control unit 105 controls the driver circuit 103 of the conveying motor 104 to control the driving of the conveying motor 104. Hereinafter, the punching motor 102, which is a first motor of the first embodiment, is a stepping motor. On the other hand, the conveying motor 104, which is a second motor, will be described as a DC brushless motor in which Hall elements that output a pulse signal at a cycle proportional to the number of revolutions is integrated. The conveying motor 104 outputs an FG pulse signal to the driver circuit 103 of the conveying motor 104. The driver circuit 115 of the punching motor 102 drives the punching motor 102 to rotate the punch unit 62 which is the punch unit. Here, the punch unit 62 includes a punch 202 and a die 205. The driver circuit 103 of the conveying motor 104 drives the conveying motor 104 to rotate the upstream roller 21*b* and the downstream roller 22*b*.

The sensor control unit 108 performs three operations. The first is an operation of detecting the presence or absence of the sheet P from a change in an output signal (hereinafter, referred to as an inlet sensor signal.) of the inlet sensor 27. Note that in a case where the leading edge of the sheet P reaches the inlet sensor 27, the inlet sensor signal rises from a low level to a high level, for example, and in a case where a trailing edge of the sheet P passes through the inlet sensor 27, the inlet sensor signal falls from a high level to a low level, for example. The low level and the high level of the inlet sensor signal may be opposite.

The second is the next operation. First, a surface speed of the upstream roller 21*a* is detected based on a rotation cycle detected from a pulse signal output from an upstream roller cycle sensor 114 (hereinafter, simply referred to as a cycle sensor 114) which is a first detection unit for detecting the surface speed of the upstream roller 21*a*. The rotation speed of the conveying motor 104 is calculated based on the detected surface speed of the upstream roller 21*a*. A method of detecting the rotation cycle of the upstream roller 21*a* and calculating the rotation speed of the conveying motor 104 will be described in detail in <Method of Calculating and Adjusting Speed of Conveying Motor 104> to be described later. The third is an operation of detecting a signal of a home position sensor 130 that outputs a pulse signal for each rotation cycle of the punch 202. The home position sensor 130 is configured to output a pulse signal by repeating light shielding and light transmitting by a photointerrupter (not illustrated) cutting off a flag (not illustrated). Note that the pulse signal is output to the sensor control unit 108 from a downstream roller cycle sensor 131 (hereinafter, simply referred to as a cycle sensor 131) which is a third detection unit for detecting the surface speed of the downstream roller 22*a*. The functions of the image forming apparatus 1 and the post-processing apparatus 4 have been described above.

Punching Section of Punch Unit

Next, the punch unit 62 will be described with reference to FIGS. 3A to 3D. In FIGS. 3A to 3D, the conveyance direction of the sheet P is also indicated by an arrow. In FIGS. 3A to 3D, in the punch unit 62, the punch 202 and the die 205 each are pivotally supported by a casing (not illustrated). A gear (not illustrated) fixed to one end of a support shaft 65 of the punch 202 and one end of the support shaft 66 of the die 205 meshes with a gear (not illustrated) provided on an output shaft of the punching motor 102. By the rotational driving of the punching motor 102, the punch 202 is configured to be rotatable in a clockwise direction in FIGS. 3A to 3D, and the die 205 is configured to rotate synchronously in a counterclockwise direction. The die 205 is provided with a die hole 206 at a position where the punch 202 is received in a case where the punching is performed. FIGS. 3A, 3B, 3C, and 3D illustrate a state in which the conveyed sheet P is punched by the punch unit 62, which is the punching device, over time.

Figure 3A:
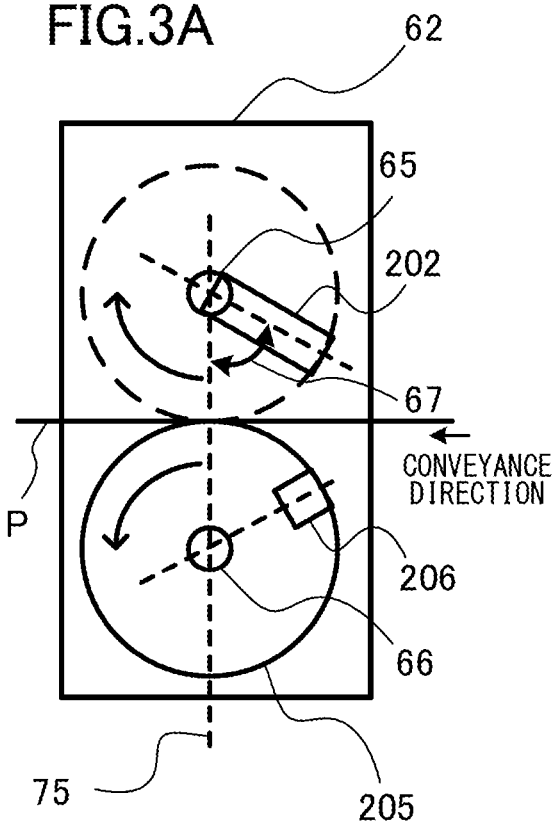
FIGS. 3A to 3D are cross-sectional views of a punch unit of the first to third embodiments.
Figure 3B:
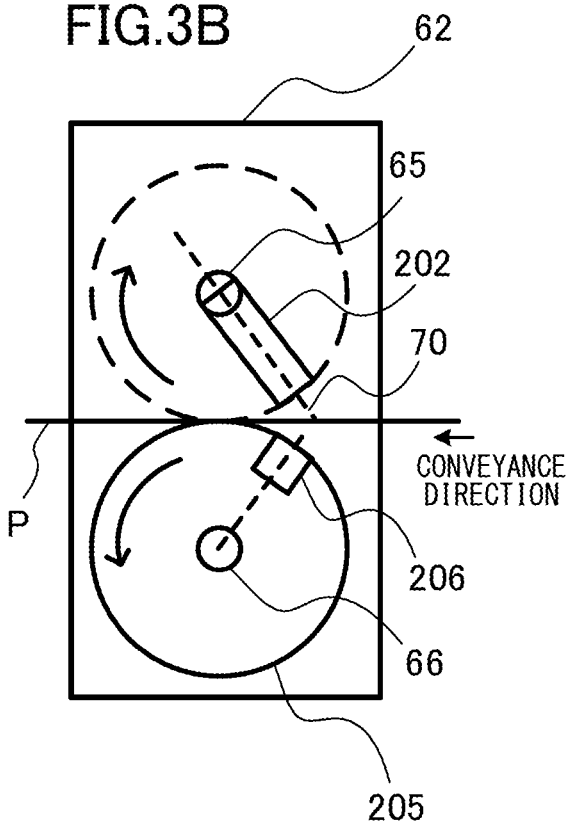
Figure 3C:
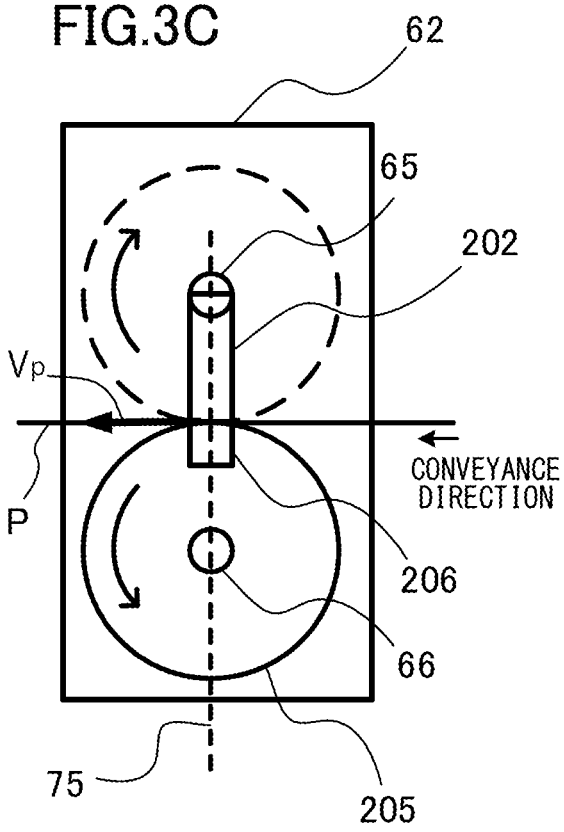
Figure 3D:
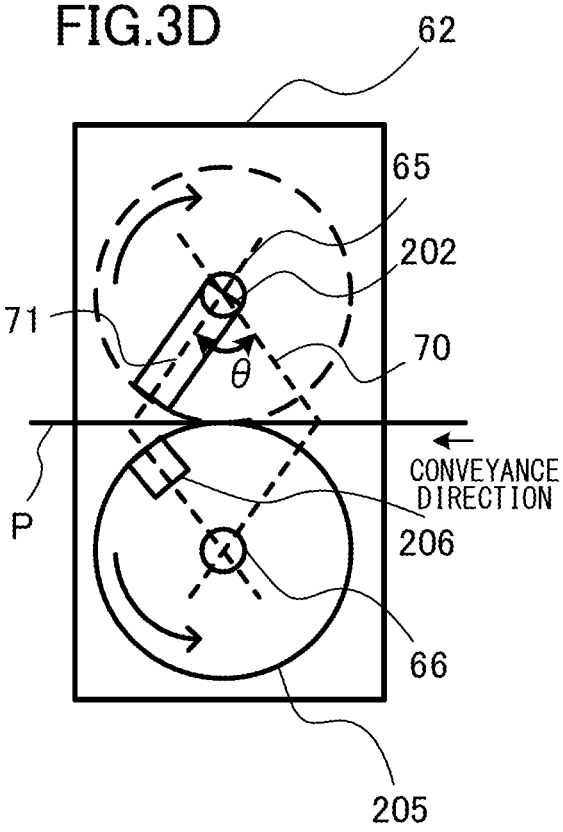

FIG. 3A illustrates that a rotational position of the punch 202 is at a home position. Here, a position illustrated in FIG. 3C where the sheet P is punched is referred to as a punching position, and a position of a virtual line connecting the support shaft 65 and the support shaft 66 is referred to as a punching center position 75. The punch 202 in FIG. 3A is at a position on a front side in the rotation direction from the punching center position 75 by an angle indicated by an arrow 67, and the punch 202 is usually stopped at the position and waits for the conveyance of the conveyed sheet P. Even if the punch 202 is stopped at the home position, the conveyance of the sheet P is not hindered. FIG. 3B illustrates that the rotational position of the punch 202 is in a punching start position 70 which is a first position where the sheet P begins to be punched. FIG. 3C illustrates a position where the punch 202 and the die hole 206 just mesh with each other and the sheet P is punched, that is, the above-described punching position. The punching position is the punching center position 75. FIG. 3D illustrates that the rotational position of the punch 202 is at a punching end position 71 which is a second position where the punching is finished. Here, an acute angle θ between the punching start position 70 and the punching end position 71 illustrated in FIG. 3D is a punching section. Other angles (360°−θ) are non-punching sections excluding a punching section.

In synchronization with the timing at which the leading edge of the sheet P is detected by the inlet sensor 27 via the sensor control unit 108, the motor control unit 105 starts the rotational driving of the punch unit 62 that puts on standby at the home position at a predetermined timing by the punching motor 102. In addition, the motor control unit 105 can cause the conveyance speed of the sheet P and the rotation speed of the punch unit 62 to match each other, thereby punching the sheet P at a desired position without stopping the conveyance of the sheet P. A tangential component of the rotation speed due to a rotational motion of the punch 202 and the die 205 illustrated in FIG. 3C is Vp.

It is assumed that the home position sensor 130 is in a light shielding state in a range (punching section) from the punching start position 70 where the punch unit 62 starts to punch the sheet P to the punching end position 71. In the other ranges (non-punching sections) of the punch unit 62, the home position sensor 130 is in a light transmitting state. In the operation of stopping the punch 202 before the sheet P is conveyed, the motor control unit 105 performs control as follows. That is, the motor control unit 105 stops the punch unit 62 by driving the punching motor 102 by a predetermined number of steps from the timing at which the home position sensor 130 transitions from the light shielding state to the light transmitting state. In this way, the motor control unit 105 rotates the punch unit 62 from the position of FIG. 3D to the position of FIG. 3A and stops the punch unit 62 at the home position. The punching section, which is the first section from the first position to the second position of the punch unit 62, has been described above.

Sheet Conveyance Control and Punching Control of Punch Unit

Figure 4A:
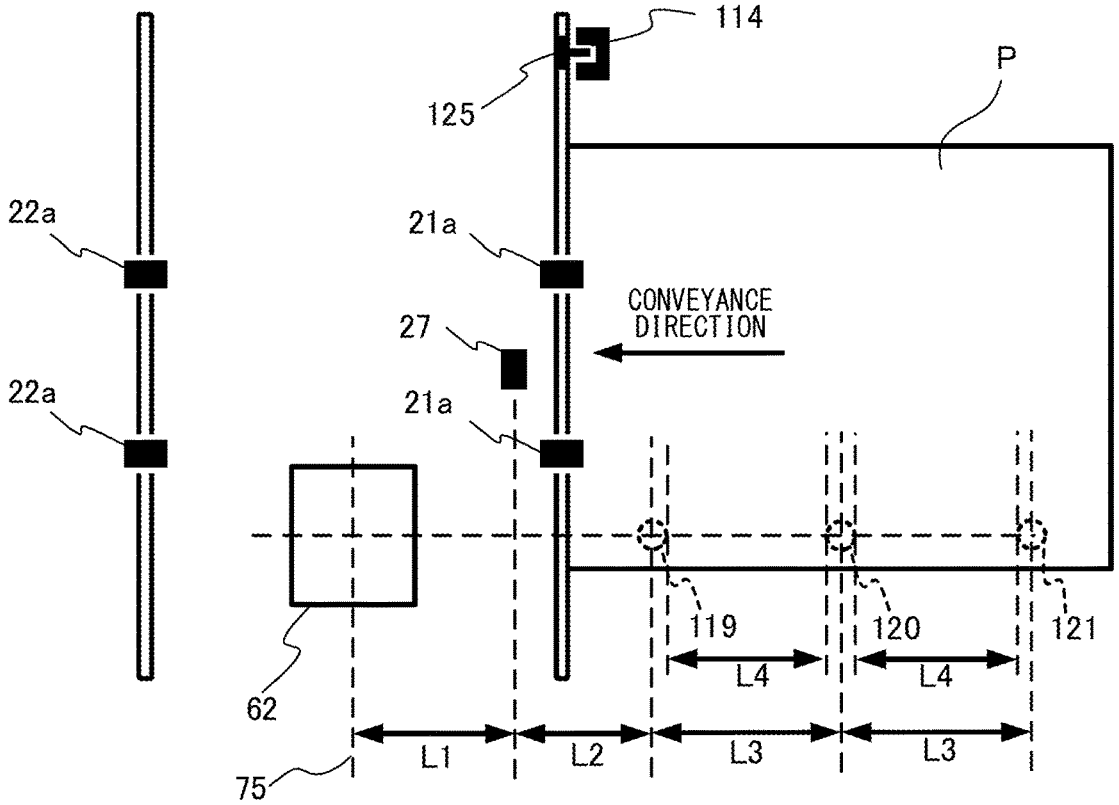
FIGS. 4A and 4B are plan views illustrating main parts of the post-processing apparatus according to the first embodiment.
Figure 4B:
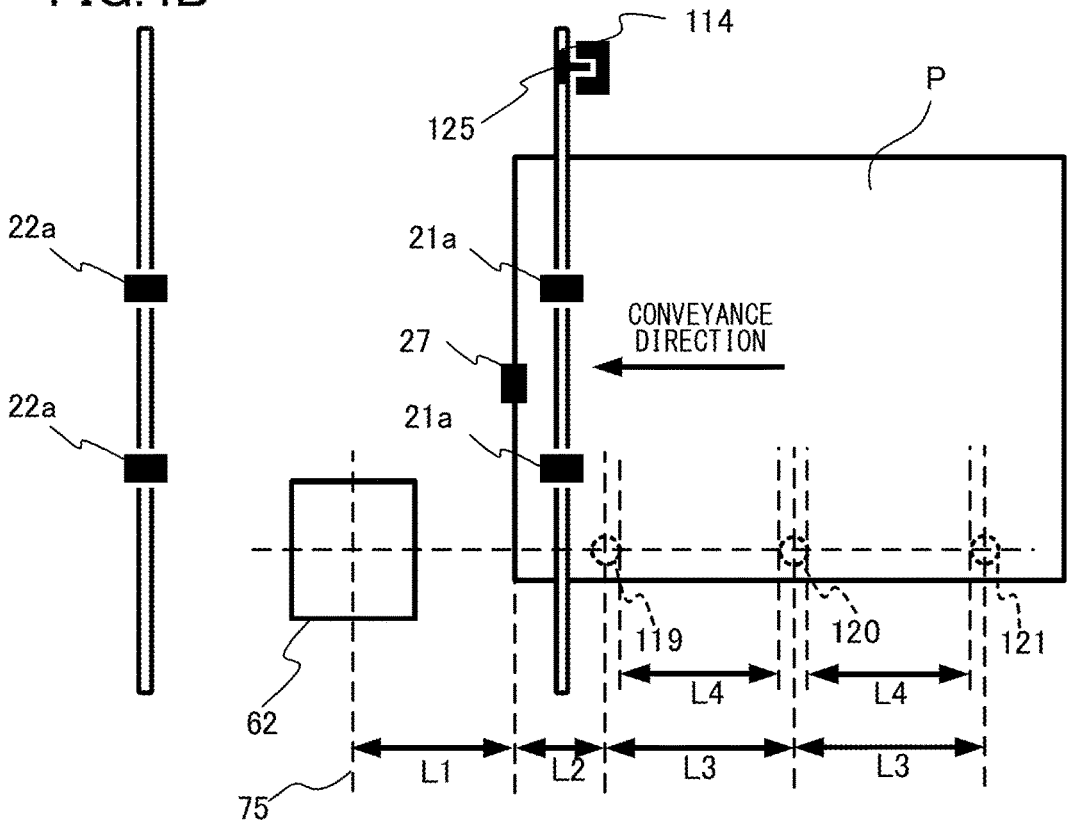

The conveyance control of the sheet P and the punching control of the punch unit 62 will be described with reference to FIGS. 4A and 4B. FIG. 4A is a view illustrating a main part in the vicinity of the punch unit 62 of the post-processing apparatus 4 as viewed from above. FIG. 4A is a plan view of the post-processing apparatus 4 in a state where the leading edge of the sheet P reaches the upstream roller pair 21, and FIG. 4B is a plan view of the post-processing apparatus 4 in a state where the inlet sensor 27 detects the leading edge of the sheet P. In the first embodiment, it is assumed that the punch unit 62 punches an end portion on the left side in a direction (width direction) substantially orthogonal to the conveyance direction of the sheet P, and is disposed at a position illustrated in FIGS. 4A and 4B. Note that the right end of the sheet P may be punched. Reference numerals 119, 120, and 121 indicated by broken line circles indicate ideal hole positions in a case where three holes are punched in the sheet P. Holes drawn with broken lines indicate that the holes are about to be punched, and the holes drawn with solid lines that appear below indicate that the holes have already been punched.

Reference signs denoted by "L" in FIGS. 4A and 4B indicate distances in the conveyance direction. A distance L1 is a distance between the punching center position 75 of the punch unit 62 and the inlet sensor 27 (center position in conveyance direction, hereinafter same). A distance L2 is a distance between the inlet sensor 27 and a center position of the ideal hole position 119 in the conveyance direction. A distance L3 is a distance between the center of the ideal hole position 119 (or hole position 120) and the center of the next hole position 120 (or hole position 121), that is, an interval between the holes. A distance L4 is a distance between an end (trailing edge) of the hole position 119 (or the hole position 120) and an end (leading edge) of the next hole position 120 (or the hole position 121). In addition, in FIGS. 4A and 4B, in the upstream roller pair 21 and the downstream roller pair 22, two rollers are each arranged at a predetermined interval in a direction substantially orthogonal to the conveyance direction. In addition, in FIGS. 4A and 4B, the upstream roller pair 21 and the downstream roller pair 22 each represent the upstream roller 21*a* and the downstream roller 22*a* on the driven side.

In a case where a print instruction in a punch mode, which is a mode for performing the punching operation on the sheet P, is transmitted from the image forming control unit 111 to the post-processing control unit 101, the post-processing control unit 101 causes the motor control unit 105 to control the punch mode. The motor control unit 105 drives the conveying motor 104 and controls the rotation speed of the conveying motor 104 so that the cycle of the FG pulse signal input from the conveying motor 104 becomes an ideal cycle. The upstream roller pair 21 and the downstream roller pair 22 rotate by being driven by the conveying motor 104 to convey the sheet P. The conveyance speed of the sheet P is obtained from the rotation speed of the conveying motor 104, a reduction ratio of a drive gear (not illustrated), and a diameter of each roller of the upstream roller pair 21 and the downstream roller pair 22. For example, the conveyance speed of the sheet P is Vs [mm/sec], and the rotation speed (number of revolutions) of the conveying motor 104 is Vsmotor [rpm]. In addition, the reduction ratio of the drive gear connecting from the conveying motor 104 to the upstream roller pair 21 is Ks, and a radius of each roller of both the upstream roller pair 21 and downstream roller pair 22 is Rs. In this case, the conveyance speed Vs of the sheet P is obtained by the following Equation (1).

$$Vs = Rs \times 2\pi Vs\text{motor} \times Ks \quad (1)$$

The sheet P supplied from the horizontal conveyance unit 14 to the upstream roller pair 21 is conveyed to the punch unit 62 at the conveyance speed Vs.

On the other hand, the punch unit 62 is put on standby at the punching start position 70 (also a standby position) until the leading edge of the sheet P reaches the inlet sensor 27. In a case where the inlet sensor 27 detects the leading edge of the sheet P and a predetermined time has elapsed, the motor control unit 105 starts driving the punching motor 102. In this case, a waiting time (hereinafter, referred to as a waiting time.) until the punching motor 102 is driven is Tstop. The punching motor 102 is controlled to be a predetermined rotation speed based on a predetermined speed profile, and performs a first punching at the ideal hole position 119 (hereinafter, also referred to as the planned hole position 119 of the first hole.) on the sheet P. The rotation speed of the punching motor 102 is set such that the speed Vp in the tangential direction of the rotational motion of the punch 202 and the die 205 illustrated in FIG. 3C matches the conveyance speed Vs of the sheet P (Vp=Vs). Note that the conveyance speed Vs of the sheet P described herein is an ideal conveyance speed in a case where it is assumed that the diameter of the upstream roller 21*b* does not change. That is, the punch unit 62 is controlled at a rotation speed that matches the ideal conveyance speed of the sheet P.

Here, the time from when the inlet sensor 27 detects the leading edge of the sheet P to when the planned hole position 119 of the first hole reaches the punching center position 75 is Ts. The time during which the punch 202 and the die 205 rotate with a predetermined speed profile between FIGS. 3A and 3C is Tp. The waiting time Tstop is determined from the time Ts and the time Tp. In a case where the conveyance speed Vs of the sheet P is constant and the distances L1 and L2 are used, the time Ts is obtained by the following Equation (2).

$$Ts=(L1+L2)/Vs \quad (2)$$

In addition, the waiting time Tstop is obtained by the following Equation (3).

$$Tstop=Ts-Tp \quad (3)$$

For example, in a case where the distance L1 set to 20 [mm], the distance L2 set to 31.7 [mm], and Vs set to 314 [mm/sec] are substituted into Equation (2), Ts=164.6 [msec] is obtained. In a case where the time Tp is set to 50 [msec], and the time Ts and the time Tp are substituted into Equation (3), the waiting time Tstop=114.6 [msec] is obtained. The waiting time Tstop varies depending on the number of holes to be punched on the sheet P and a length (sheet size) of the sheet P in the conveyance direction. In the first embodiment, for example, a method of obtaining the waiting time Tstop has been described by taking the condition for punching three holes on the sheet P of, for example, LETTER size.

In a case where continuously punching the sheet P, the motor control unit 105 drives the punching motor 102 with a predetermined speed profile from the punching end position 71 to the punching start position 70 in FIG. 3. Thus, the second hole and the third hole can be punched at the ideal hole positions 120 and 121 on the sheet P.

Further, between the preceding sheet P and the succeeding sheet P, the motor control unit 105 drives the punching motor 102 with the predetermined speed profile to rotate to the home position, and temporarily stops the punch 202 and the die 205 at that position. In a case where the leading edge of the next sheet P reaches the inlet sensor 27, the post-processing control unit 101 again waits for the waiting time Tstop similar to the first sheet and then drives the punching motor 102. The sheet conveyance control and the punching control of the punch unit 62 have been described above.

Deviation in Diameters of Upstream Roller and Downstream Roller

Next, the deviation in the diameters of the upstream roller 21*b* and the downstream roller 22*b* will be described. In the first embodiment, in order to impart a conveying force to the sheet P, a rubber roller having a relatively large friction with the sheet P is used for the upstream roller 21*b* and the downstream roller 22*b*. On the other hand, the upstream roller 21*a* and the downstream roller 22*a* on the driven side use rollers made of a resin material having less friction with the sheet P in order not to hinder the conveyance of the sheet P by the upstream roller 21*b* and the downstream roller 22*b* on the drive side. The cycle sensor 114 detects the rotation cycle of the upstream roller 21*a*, that is, the roller.

The diameter of the rubber roller changes due to surface scraping due to wear, expansion by reception of heat possessed by the sheet P thermally-fixed by the fixing unit 11, and the like. In addition, the rubber roller has a variation in tolerance in diameter during manufacturing. Due to these factors, the conveyance speed Vs of the sheet P changes (deviates) with respect to the ideal conveyance speed due to the deviation in the diameters of the upstream roller 21*b* and the downstream roller 22*b*, so the position of the first hole with respect to the leading edge of the sheet P or the interval (hereinafter, referred to as a hole interval) between the holes deviates. Hereinafter, in the first embodiment, a system in which the diameter of the downstream roller 22*b* deviates in the same manner as the diameter of the upstream roller 21*b* will be described. The deviation in the diameter of the upstream roller 21*b* has been described above.

Countermeasure Against Deviation of Diameter of Upstream Roller and Diameter of Downstream Roller Next, countermeasures against the deviation in the diameter of the upstream roller 21*b* will be described. By detecting the rotation cycle of the upstream roller 21*a* by the cycle sensor 114 and adjusting the rotation speed of the conveying motor 104, the sheet P can be conveyed at the ideal conveyance speed regardless of the deviation in the diameter of the upstream roller 21*b*.

The rotation cycle of the upstream roller 21*a* is performed using the cycle sensor 114 and the flag 125 in FIGS. 4A and 4B. As illustrated in FIGS. 4A and 4B, the flag 125 is fixed to the shaft of the upstream roller 21*a* and rotates in synchronization with the upstream roller 21*a*. The cycle sensor 114 is, for example, a photointerrupter, and outputs a pulse signal corresponding to the rotation cycle of the upstream roller 21*a* to the sensor control unit 108 by transmitting or shielding light by the rotation of the flag 125. Here, for example, in a case where the flag 125 shields light, the pulse signal becomes a low level, and in a case where light is transmitted, the pulse signal becomes a high level. Note that the level of the pulse signal may be reversed.

For example, in a case where the diameter of the upstream roller 21*b* is larger than the ideal value, the rotation cycle becomes long. The post-processing control unit 101 can control the conveyance speed Vs of the sheet P to the ideal conveyance speed by increasing the rotation speed of the conveying motor 104 so that the rotation cycle obtained based on the pulse signal becomes the ideal cycle. As a result, it is possible to reduce the deviation in the position of the first hole with respect to the leading edge of the sheet P or the hole interval. The countermeasure against the deviation in the diameter of the upstream roller 21*a* has been described above. Note that the process can also be applied to the deviation in the diameter of the downstream roller 22*b*, and the process may be similarly performed using the cycle sensor 131 of the downstream roller pair 22 of FIG. 2.

Method of Calculating and Adjusting Speed of Conveying Motor

Figure 5:
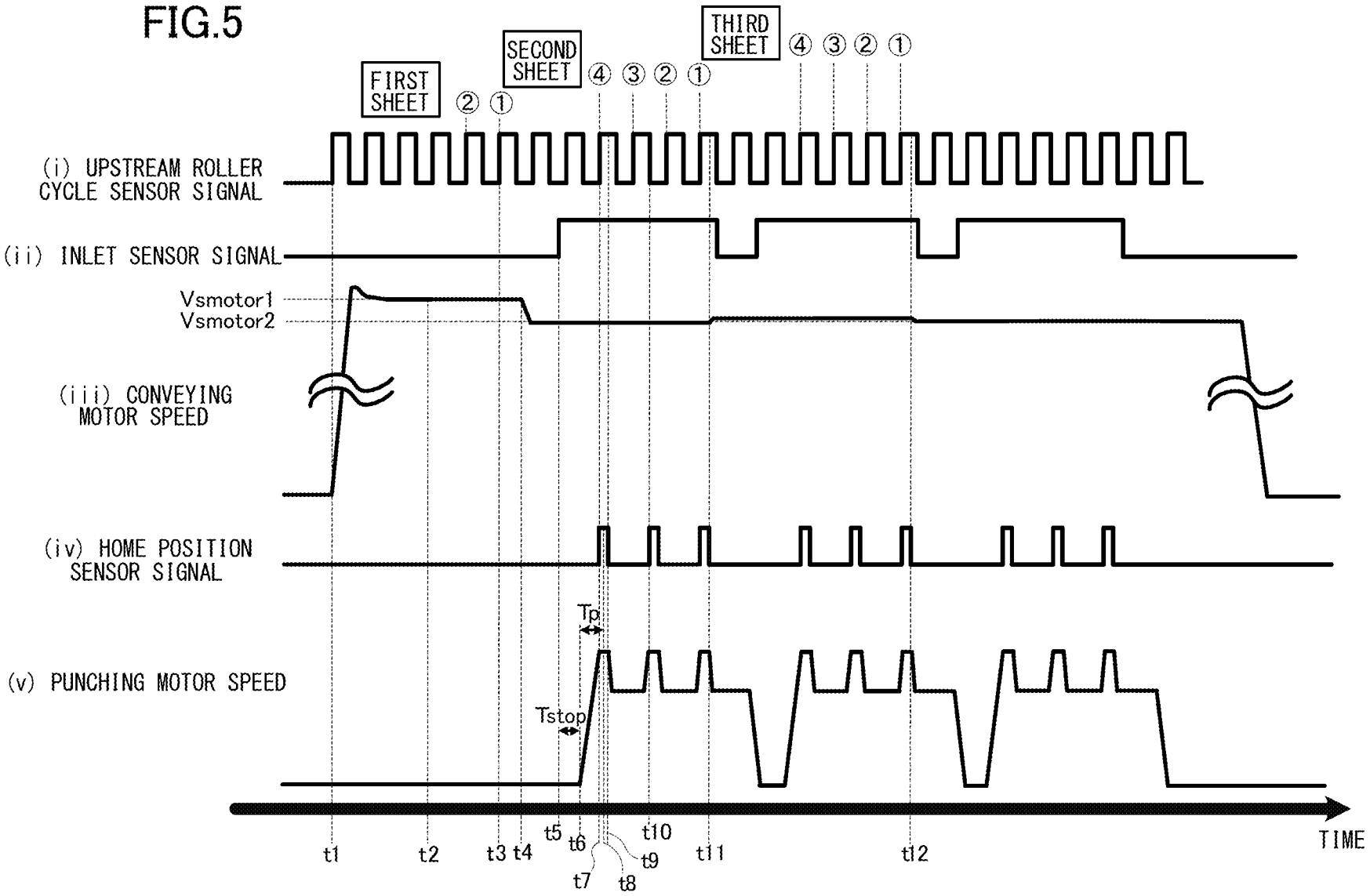
FIG. 5 is a diagram illustrating a sequence of each motor and each sensor according to the first embodiment.

Next, a method of calculating and adjusting the rotation speed of the conveying motor 104 will be specifically described. FIGS. 5(*i*) to 5(*v*) are diagrams illustrating a rotation speed of each motor and an output signal of each sensor on a time axis in a case where three holes are punched in three LETTER-sized sheets. FIG. 5(*i*) illustrates a pulse signal (illustrated as an upstream roller cycle sensor signal) output from the cycle sensor 114 of the upstream roller pair 21, and in FIG. 5(*ii*) illustrates an inlet sensor signal output from the inlet sensor 27. FIG. 5(*iii*) illustrates the rotation speed of the conveying motor 104, FIG. 5(*iv*) illustrates the signal (illustrated as the home position sensor signal) output from the home position sensor 130, and FIG. 5(*v*) illustrates the rotation speed of the punching motor 102. The home position sensor signal illustrated in FIG. 5(*iv*) is at a high level in the punching section and at a low level in the non-punching section, but may be vice versa. The circled numbers 1 to 4 indicate the number of rotation cycles of a rising edge starting point of the pulse signal of the cycle sensor 114 counted by the sensor control unit 108. For example, a first round number 2 and a round number 1 in FIG. 5(*i*) indicate the latest two cycles among the plurality of measured rotation cycles in a case where the post-processing control unit 101 adjusts the rotation speed of the conveying motor 104. Similarly, the circled numbers 4 to 1 indicate the latest four rotation cycles among the plurality of measured rotation cycles in a case where the post-processing control unit 101 adjusts the rotation speed of the conveying motor 104. Any horizontal axis represents time. Note that Vsmotor1 is the rotation speed of the conveying motor 104 obtained by the rotation cycle, and Vsmotor2 is the adjusted rotation speed to be described later.

A timing t1 is a timing at which the conveying motor 104 is started, and a pulse signal of the cycle sensor 114 is also output in synchronization with the driving of the conveying motor 104. For example, the post-processing control unit 101 activates (starts driving) the conveying motor 104 by the motor control unit 105 at the timing at which the punch mode information is received from the image forming control unit 111. In addition, the post-processing control unit 101 may activate the conveying motor 104 by the motor control unit 105 based on the signal output from the conveyance sensor 135 via the image forming control unit 111. At the timing t1 to timing t2, the sensor control unit 108 waits for a time from the activation of the conveying motor 104 until the rotation speed is stabilized.

The post-processing control unit 101 causes the sensor control unit 108 to start measuring the rotation cycle at the timing t2. Note that it is assumed that the post-processing control unit 101 continues the measurement of the rotation cycle by the cycle sensor 114 until the processing ends. Regarding the plurality of measured rotation cycles, for example, a plurality of latest rotation cycles may be temporarily stored in a storage unit (not illustrated). A timing t3 is a timing at which the rotation cycle of the upstream roller 21*a* has been measured for two cycles. The sensor control unit 108 averages the measured values for two cycles, and calculates the rotation speed of the conveying motor 104 at the time of punching corresponding to the first sheet P using the averaged value. Here, the averaging is performed in order to level the variation in the rotational behavior of the upstream roller 21*b*.

Assuming that the ideal rotation cycle and the measured rotation cycle are Tr1 and Tr2, respectively, and the current speed of the conveying motor 104 is Vsmotor1, the adjusted speed Vsmotor2 of the conveying motor 104 is obtained by the following Equation (4).

$$Vs\text{motor2}=Tr2/Tr1\times Vs\text{motor1} \quad (4)$$

For example, the ideal rotation period Tr1 set to 100 [msec], the measured rotation period Tr2 set to 105 [msec], and the current rotation speed Vsmotor1 of the conveying motor 104 set to 1000 [rpm] are substituted into the Equation (3). Then, the rotation speed Vsmotor2 of the conveying motor 104 after the adjustment becomes 1050 [rpm].

As described above, in a case where the current rotation period is longer than the ideal rotation period, that is, in a case where the rotation speed of the upstream roller pair 21 is 5 [%] slower than the ideal rotation period, the rotation speed of the conveying motor 104 increases by 5 [%], so that the rotation period can be made closer to the ideal rotation period. On the other hand, in a case where the current rotation cycle is shorter than the ideal rotation cycle, for example, in a case where the rotation speed is 5 [%] faster, the same effect can be obtained by delaying the rotation speed of the conveying motor 104 by 5 [%] using Equation (4).

A timing t4 is a timing at which the motor control unit 105 changes the rotation speed Vsmotor1 obtained based on the rotation cycle to the adjusted rotation speed Vsmotor2. A timing t5 is a timing at which the inlet sensor 27 detects the leading edge of the sheet P. Here, since the punching motor 102 is driven with the predetermined speed profile, in a case where the conveyance speed Vs of the sheet P changes after the timing t5 at which the leading edge of the sheet P is detected by the inlet sensor 27, the position at which the first hole is punched deviates. Therefore, it is preferable that the adjustment of the rotation speed of the conveying motor 104 ends before the state (timing t5) (for example, the state of FIG. 4A) of FIG. 4B in which the inlet sensor 27 detects the leading edge of the sheet P as in the first embodiment. That is, the post-processing control unit 101 preferably adjusts the rotation speed of the conveying motor 104 before the inlet sensor 27 detects the leading edge of the sheet P.

A timing t6 is a timing at which the punching motor 102 is started after the time Tstop has elapsed from the timing t5. A timing t7 is a timing at which the first hole starts to be punched on the sheet P, a timing t8 is a timing at which the punch 202 and the die 205 are at the punching center position 75, and a timing t9 is a timing at which the first hole ends to be punched on the sheet P. A timing t10 is a timing at which the second hole starts to be punched on the sheet P. The time from the timing t7 to the timing t10 is a time when the sheet P passes through a distance corresponding to an ideal hole interval, and the punching motor 102 rotates with the speed profile in which the punch 202 and the die 205 rotate once for this time. The home position sensor 130 outputs a high-level signal between the timing t7 and the timing t9.

A timing t11 is a timing at which the third hole has been punched on the sheet P. At this point, the post-processing control unit 101 substitutes the average value of the detection results of the latest four rotation cycles (from circled number 1 to circled number 4) into the time Tr2 in the Equation (4) to calculate the adjusted rotation speed Vsmotor2 of the conveying motor 104 corresponding to the second sheet. Then, the post-processing control unit 101 changes the rotation speed of the conveying motor 104 to the adjusted rotation speed Vsmotor2. Note that, in FIGS. 5(*i*) to 5(*v*), the rotation speed of the conveying motor 104 is adjusted before the trailing edge of the first sheet P passes through the inlet sensor 27, but since the punching operation for three holes for the first sheet P has been ended, there is no influence on the punching operation for the first sheet P. As described above, in a case where there is a succeeding sheet P continuously conveyed to the sheet P, the post-processing control unit 101 adjusts the rotation speed for conveying the succeeding sheet P by the upstream roller pair 21 after the punching operation by the punch unit 62 has been ended.

Here, there are two reasons for changing the number of times of acquisition of the rotation cycle between the first sheet P (the number of times of acquisition of the rotation cycle is twice) and the second and succeeding sheets P (the number of times of acquisition of the rotation cycle is four times). The first reason is that, in the second and succeeding sheets P, the rotation cycle varies more than that of the first sheet that is not conveying the sheet P due to load variation that occurs in a case where the upstream roller pair 21 and the downstream roller pair 22 convey the sheet P. The second reason is that a waiting time (a range from the timing t1 to the timing t2) for stabilizing the rotation speed of the conveying motor 104 is required before the first sheet of the sheet P is punched, and thus, the time to be used for the measurement is short. The number of times of acquisition for obtaining the average value of the detection results of the rotation cycle is not limited thereto, and may change according to the degree of variation in the rotation cycle or the accuracy of the punching position to be obtained.

A timing t12 is a timing at which the third hole has been punched on the second sheet P. At this time point, similar to the second sheet P, the post-processing control unit 101 calculates the rotation speed Vsmotor2 of the conveying motor 104 corresponding to the third sheet P, and changes the rotation speed to the adjusted rotation speed Vsmotor2.

In the first embodiment, the print job for three sheets P has been described as an example, but by using the same method even for a long-time print job, it is possible to approach the ideal surface speed (circumferential speed) of the upstream roller 21*b* regardless of the expansion or wear of the diameter of the upstream roller 21*b*. Further, the fact that the surface speed can be brought close to the ideal surface speed of the upstream roller 21*b* also means that the surface speed can substantially match the speed Vp in the tangential direction of the rotation speed of the punch unit 62. The method of calculating and adjusting the speed of the conveying motor 104 have been described above.

Flowchart of Speed Adjustment

Figure 6:
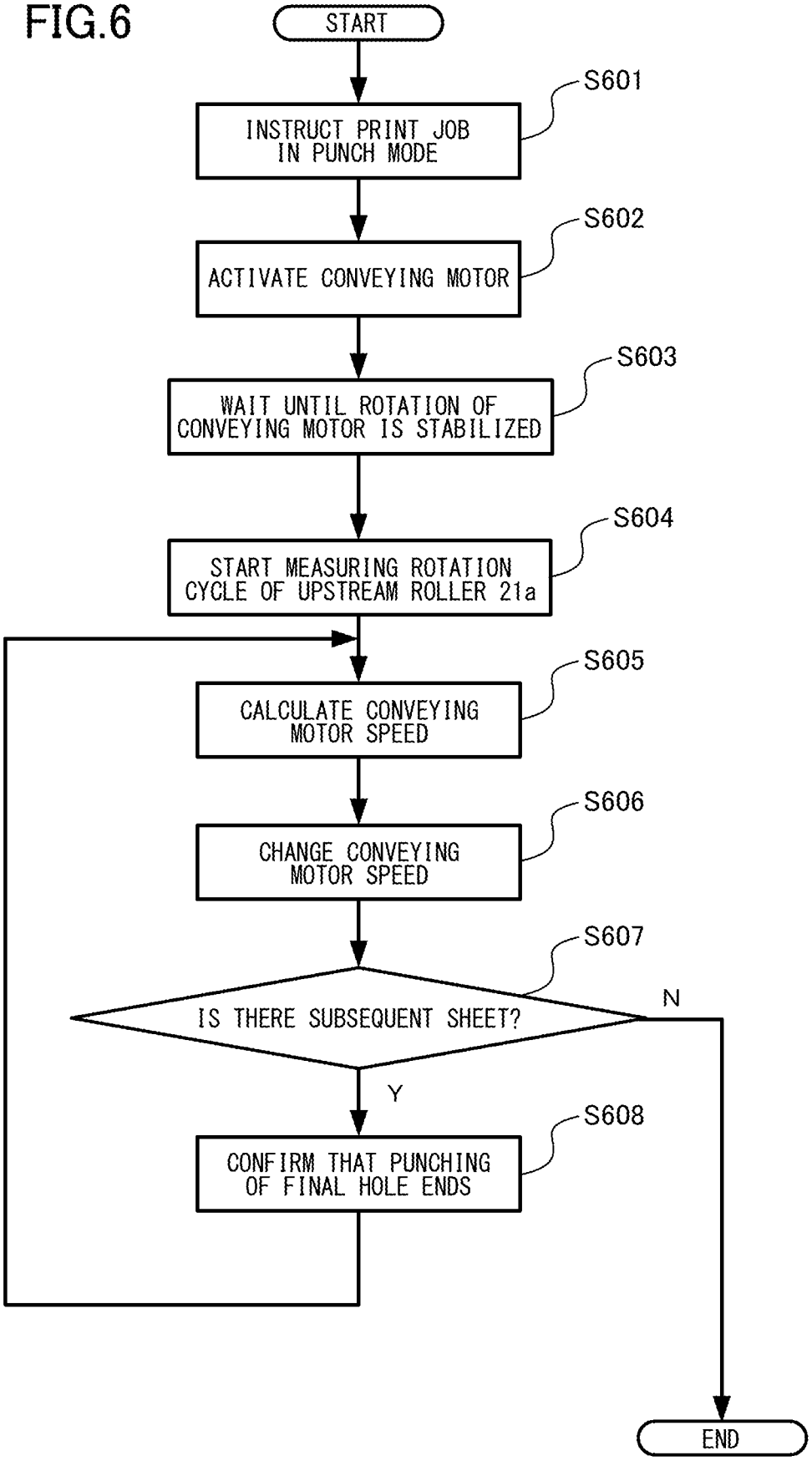
FIG. 6 is a flowchart illustrating a process of adjusting a rotation speed of a conveying motor according to the first embodiment.

Next, a flowchart for adjusting the rotation speed of the conveying motor 104 will be described with reference to FIG. 6. In step (abbreviated as S, hereinafter) 601, the post-processing control unit 101 receives an instruction of a print job in the punch mode from the image forming control unit 111. In S602, the post-processing control unit 101 causes the motor control unit 105 to activate the conveying motor 104 via the driver circuit 103. In S603, the post-processing control unit 101 waits until the rotation of the conveying motor 104 is stabilized based on the FG pulse signal output from the conveying motor 104 (waiting for stable rotation). In S604, the post-processing control unit 101 starts measuring the rotation cycle of the upstream roller 21*a* by the cycle sensor 114. In S605, the post-processing control unit 101 calculates the rotation speed of the conveying motor 104 based on the rotation cycle of the upstream roller 21*a* whose measurement has started in S604. For example, the post-processing control unit 101 averages a plurality (for example, two) of latest rotation cycles among the plurality of measured rotation cycles and uses the average for the calculation of the rotation speed. In S606, the post-processing control unit 101 causes the motor control unit 105 to change the rotation speed of the conveying motor 104 to the rotation speed (the adjusted rotation speed Vsmotor2) corresponding to the first sheet P calculated in S605. In S607, the post-processing control unit 101 determines whether there is a succeeding sheet P (succeeding sheet) based on the information received from the image forming control unit 111. In S607, in a case where it is determined that there is the succeeding sheet, the post-processing control unit 101 advances the processing to S608. In S608, the post-processing control unit 101 confirms that the final hole has been punched in the current sheet P, and returns the process to S605. In S605, for example, the post-processing control unit 101 averages a plurality (for example, four) of latest rotation cycles among the plurality of measured rotation cycles and uses the average for the calculation of the rotation speed. In S607, in a case where it is determined that there is no succeeding sheet P, the post-processing control unit 101 ends the processing. The flowchart of the speed adjustment has been described above.

As described above, according to the first embodiment, by measuring the rotation cycle of the upstream roller 21*a* and adjusting the rotation speed of the conveying motor 104, even in a case where the diameter of the upstream roller 21*b* deviates from the ideal diameter, it is possible to accurately punch the sheet P. Specifically, the following adjustment is performed based on the rotation cycle of the upstream roller 21*a* detected by the cycle sensor 114. That is, the rotation speed of the conveying motor 104 is adjusted so that the circumferential speed of the upstream roller 21*b* and the speed component in the tangential direction at the punching position of the rotation speed of the punch unit 62 substantially match each other. In the first embodiment, the punching motor 102 is a stepping motor, and the conveying motor 104 is a DC brushless motor, but the present invention is not limited to this configuration. For example, the conveying motor 104 may also be the stepping motor. A DC brushless motor may be used as the punching motor 102 as long as it is a unit that can accurately control the rotation of the punch 202 and the die 205 by finely controlling the punching motor using an encoder.

Further, in the first embodiment, the first detection unit has been described using the sensor that detects the rotation cycle of the upstream roller 21*a*, but the present invention is not limited to this configuration. For example, the surface speed of the upstream roller 21*a* may be detected using a general non-contact speed sensor using a semiconductor laser and a light receiving sensor. The same effect can be obtained by a method of irradiating the same position of the upstream roller 21*a* with two lasers, receiving, by a light receiving sensor, reflected scattered light, and detecting the surface speed of the upstream roller 21*a* from the wavelength of the scattered light.

As described above, according to the first embodiment, in the post-processing apparatus including the punch unit for punching the sheet being conveyed, the holes can be punched at a predetermined position of the sheet regardless of the deviation in the diameter of the conveying roller.

Second Embodiment

In the first embodiment, a system in which diameters of an upstream roller 21*b* and a downstream roller 22*b* deviate together with respect to an ideal diameter has been described, but in a second embodiment, a system in which the diameters deviate from each other with respect to the ideal diameter and are different from each other will be described. In the second embodiment, a method of measuring rotation cycles of both the upstream roller 21*a* and the downstream roller 22*a* and adjusting a rotation speed of a conveying motor 104 will be described. According to this method, even in a case where the diameters of both the upstream roller 21*a* and the downstream roller 22*a* each deviate from the ideal diameter, a first hole and a third hole with respect to the sheet P can be accurately punched. In the second embodiment, since a configuration of a post-processing apparatus 4 and a punching section have the same contents as those of the first embodiment, the description thereof will be omitted, and the same configurations will be described using the same reference numerals.

Figure 7A:
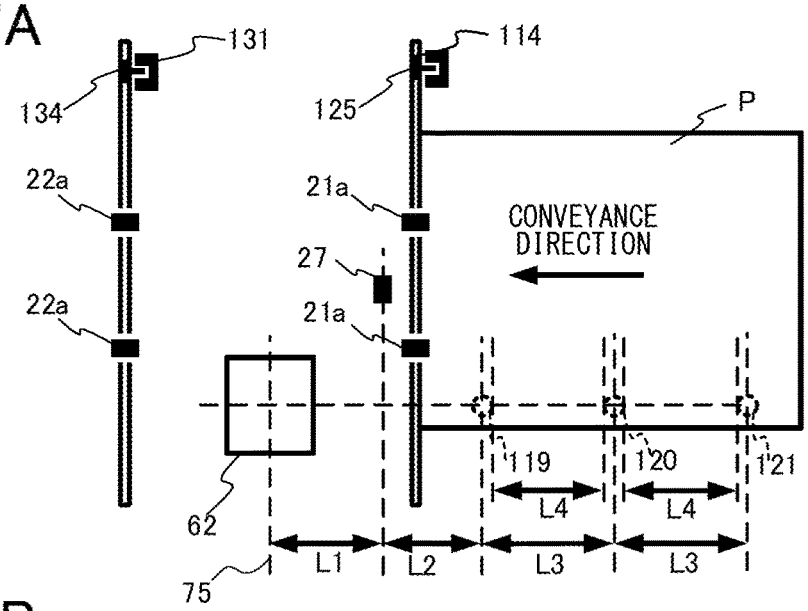
FIGS. 7A to 7C are plan views illustrating main parts of a post-processing apparatus according to a second embodiment.
Figure 7B:
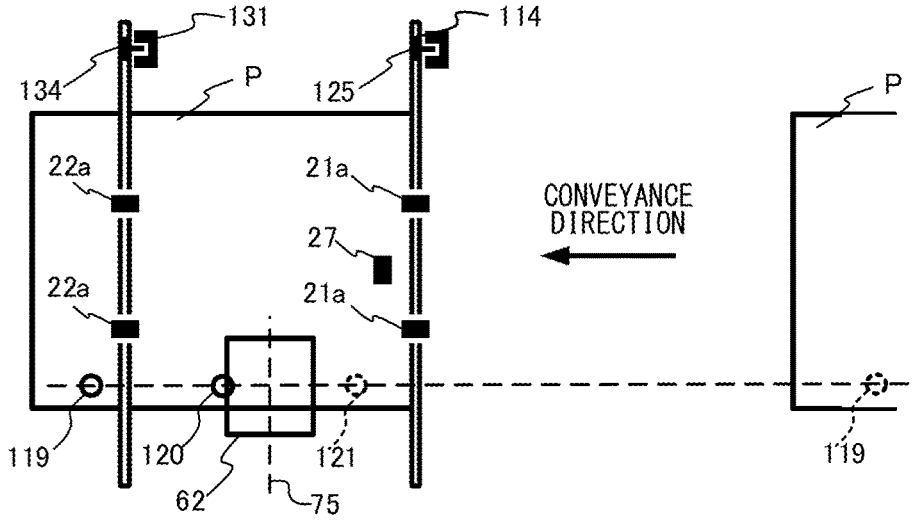
Figure 7C:
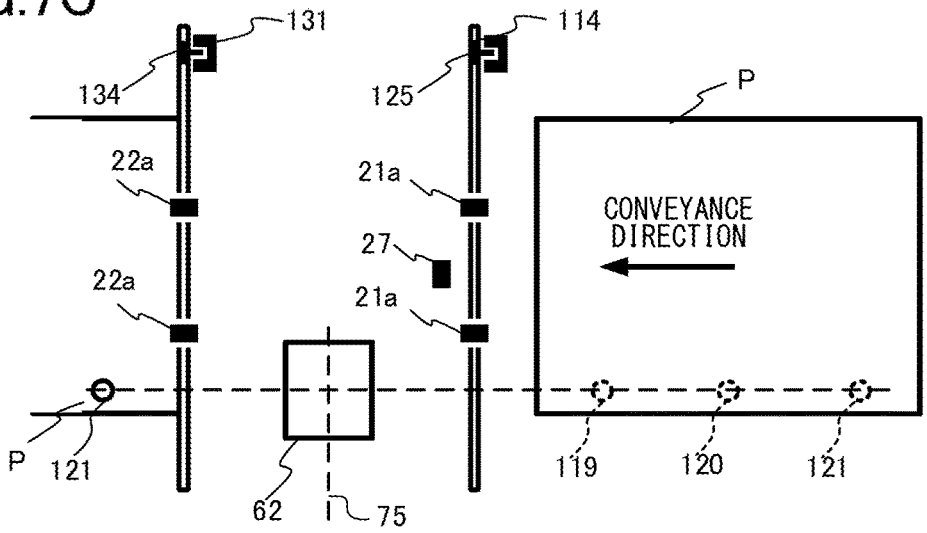

Detection Configuration of Rotation Cycles of Upstream Roller and Downstream Roller A detection configuration of rotation cycles of an upstream roller pair 21 and a downstream roller pair 22 will be described with reference to FIGS. 7A to 7C. FIG. 7A is a plan view illustrating a state in which a leading edge of a sheet P reaches the upstream roller pair 21 as in FIG. 4A, and FIG. 7B is a plan view illustrating a state in which a trailing edge of the sheet P passes through the upstream roller pair 21. FIG. 7C is a plan view of the post-processing apparatus 4 in a state where the trailing edge of the sheet P passes through the downstream roller pair 22, and illustrates a conveyance operation of the sheet Pin order. A cycle sensor 131 detects the rotation cycle of the downstream roller 22*a*, that is, the roller. Note that the same components as those in FIG. 4 are denoted by the same reference numerals, and the description thereof will be omitted.

The rotation cycle of the downstream roller 22*a* is performed using the cycle sensor 131 and the flag 134 of the downstream roller pair 22 of FIGS. 7A to 7C. The flag 134 is fixed to a shaft of the downstream roller 22*a* and rotates in synchronization with the downstream roller 22*a*. Similar to the cycle sensor 114, the cycle sensor 131 also uses a photointerrupter. The cycle sensor 131 outputs a pulse signal corresponding to the rotation cycle to the sensor control unit 108 as illustrated in FIG. 2 by transmitting or shielding light by the rotation of the flag 134. Countermeasure against Deviation in Diameter between Upstream roller and Downstream Roller Next, countermeasures against the deviation in the diameters of the upstream roller pair 21 and the downstream roller pair 22 will be described. In the state of FIG. 7B in which the trailing edge of the sheet P passes through the upstream roller pair 21, since the sheet P is conveyed only by the downstream roller pair 22, even in a case where the conveying speed corresponding to the roller diameter of the upstream roller pair 21 is set as in the first embodiment, the punching position of the third hole with respect to the sheet P deviates. Therefore, at the timing at which the trailing edge of the sheet P passes through the upstream roller pair 21, the rotation speed changes to the rotation speed of the conveying motor 104 corresponding to the roller diameter of the downstream roller pair 22. As a result, the hole that has not been punched yet at the timing at which the trailing edge of the sheet P passes through the upstream roller pair 21, that is, the punching position of the third hole of the sheet Pin FIGS. 7A to 7C can be brought close to the ideal position of the sheet P.

Figure 8:
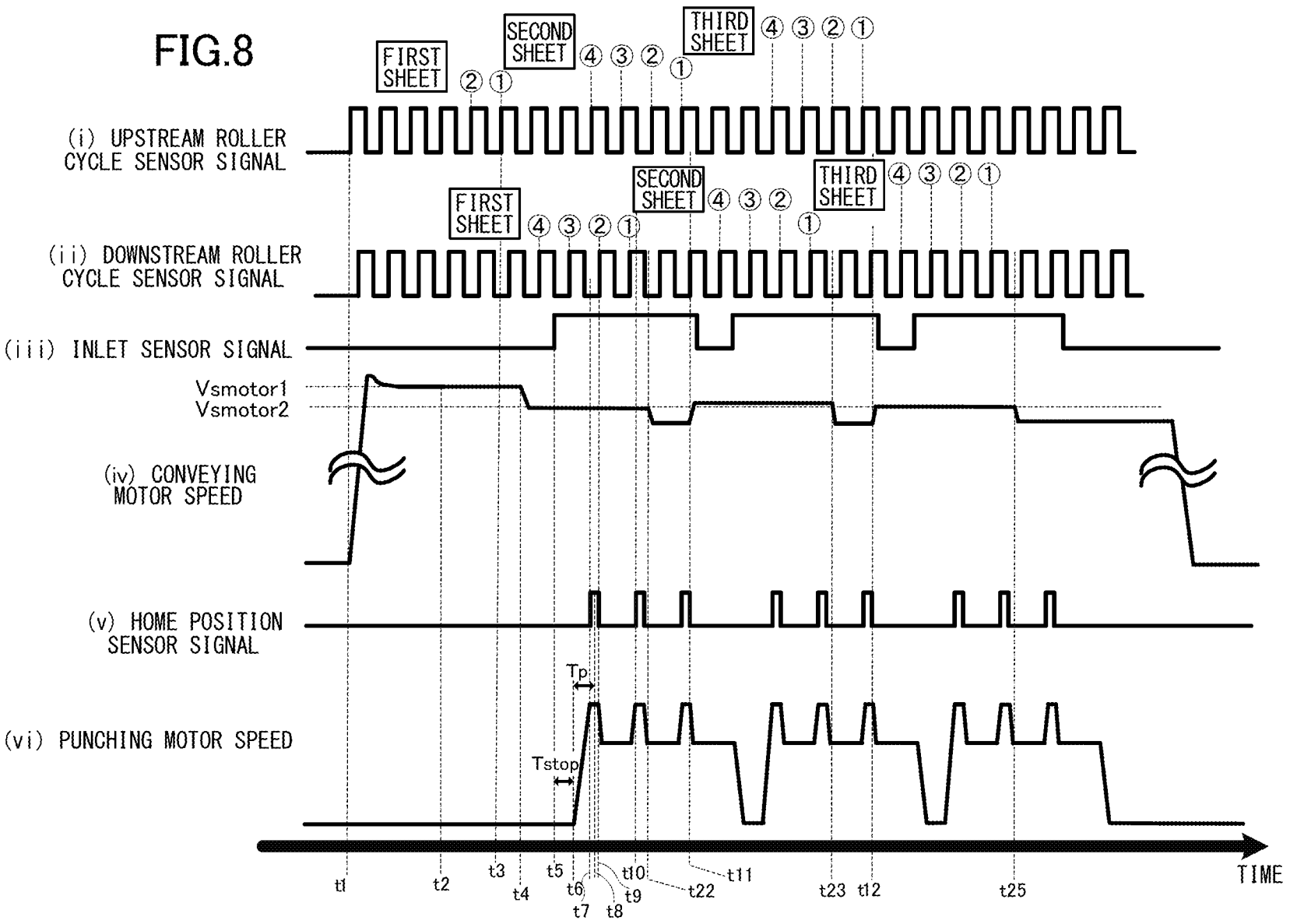
FIG. 8 is a diagram illustrating a sequence of each motor and each sensor according to the second embodiment.

FIGS. 8(*i*) to 8(*vi*) are diagrams illustrating a rotation speed of each motor and a signal output from each sensor in a case where three holes are punched on each of three sheets P of LETTER size in the configuration of the second embodiment on a time axis. FIGS. 8(*i*) and 8(*iii*) to 8(*vi*) are graphs similar to FIGS. 5(*i*) to 5(*v*) described in the first embodiment, and the description thereof will be omitted. A timing t1 to a timing t12 are similar to those in FIGS. 5(*i*) to 5(*v*), and the description thereof will be omitted. FIG. 8(*ii*) illustrates a pulse signal (illustrated as a downstream roller cycle sensor signal) output from the cycle sensor 131 of the downstream roller pair 22. Note that it is assumed that the post-processing control unit 101 continues the measurement of the rotation cycle by the cycle sensor 131 until the processing ends. Regarding the plurality of measured rotation cycles, for example, a plurality of latest rotation cycles may be temporarily stored in a storage unit (not illustrated).

Similar to first embodiment, the post-processing control unit 101 measures the rotation cycle of the upstream roller 21*a* by the cycle sensor 114, and changes the rotation speed of the conveying motor 104 at timing t4. At a timing t22 at which the trailing edge of the first sheet P passes through the upstream roller pair 21, the post-processing control unit 101 acquires the latest four rotation cycles in which the pulse signal output from the cycle sensor 131 is measured by the sensor control unit 108, and averages the measured values. The timing t22 is preferably determined using, for example, an ideal time from when the inlet sensor 27 detects the leading edge of the sheet P (timing t5) to when the trailing edge of the sheet P passes through the upstream roller pair 21. As described above, the post-processing control unit 101 adjusts the rotation speed of the conveying motor 104 after the trailing edge of the sheet P passes through the upstream roller pair 21.

The post-processing control unit 101 substitutes the measurement result into the time Tr2 using the Equation (4) of the first embodiment to calculate the adjusted rotation speed Vsmotor2, and changes the rotation speed of the conveying motor 104 to the adjusted rotation speed Vsmotor2. At a timing t11 at which the third hole has been punched on the sheet P, the post-processing control unit 101 acquires the latest four rotation cycles obtained by measuring the signal output from the cycle sensor 114 by the sensor control unit 108. Thereafter, the post-processing control unit 101 changes the rotation speed to the rotation speed of the conveying motor 104 corresponding to the second sheet in the same manner as in the first embodiment. As a result, the hole position of the first hole of the second sheet P can be punched at the ideal position 119.

A timing t23 is a timing at which the trailing edge of the second sheet P passes through the upstream roller pair 21. The post-processing control unit 101 changes the rotation speed of the conveying motor 104 based on the detection result of the cycle sensor 131 of the downstream roller pair 22. The timing t12 is a timing at which the third hole has been punched on the second sheet P. The post-processing control unit 101 changes the rotation speed of the conveying motor 104 based on the detection result of the cycle sensor 114 of the upstream roller pair 21. A timing t25 is a timing at which the trailing edge of the third sheet P passes through the upstream roller pair 21. The post-processing control unit 101 changes the rotation speed of the conveying motor 104 based on the detection result of the cycle sensor 131 of the downstream roller pair 22. Similar to the first sheet P, by changing the rotation speed of the conveying motor 104 based on the rotation cycles of the pulse signals output from the cycle sensor 114 and the cycle sensor 131, it is possible to punch holes at ideal positions with respect to the sheet P. The countermeasure against the deviation in the roller diameters of the upstream roller pair 21 and the downstream roller pair 22 has been described above.

Flowchart of Speed Adjustment of Second Embodiment

Figure 9:
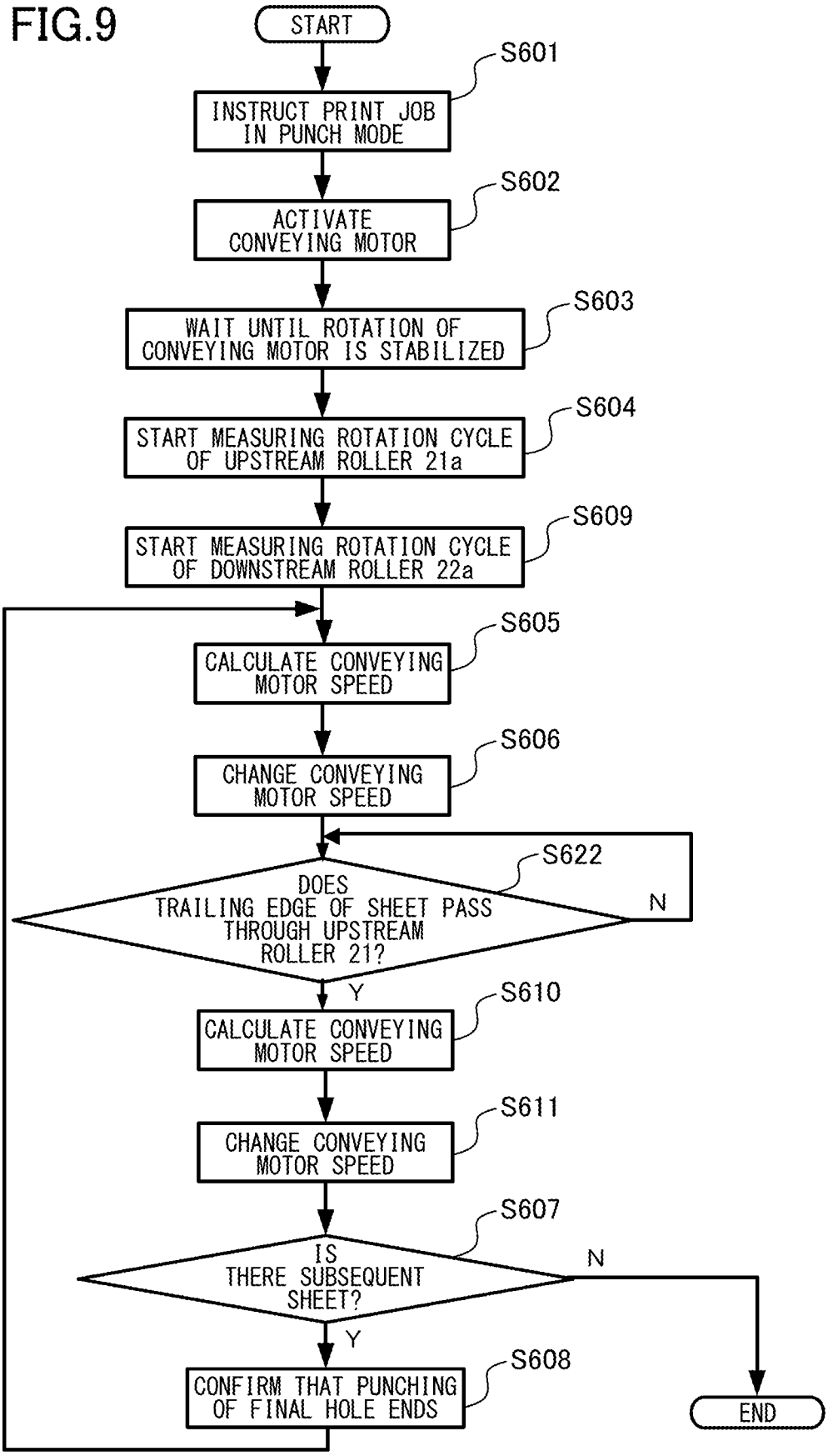
FIG. 9 is a flowchart illustrating a process of adjusting a rotation speed of a conveying motor according to the second embodiment.

Next, a flowchart for adjusting the rotation speed of the conveying motor 104 will be described with reference to FIG. 9. Processes similar to those in the first embodiment are denoted by the same step numbers, and the description thereof will be omitted. The post-processing control unit 101 starts measuring the rotation cycle of the upstream roller 21*a* by the cycle sensor 114 in S604, and starts measuring the rotation cycle of the downstream roller 22*a* by the cycle sensor 131 in S609. After changing the rotation speed of the conveying motor 104 based on the detection result of the rotation cycle of the upstream roller 21*a* in S606, the post-processing control unit 101 determines whether the trailing edge of the sheet P passes through the upstream roller pair 21 in S622. In a case where it is determined that the trailing edge of the sheet P does not pass through the upstream roller pair 21 in S622, the post-processing control unit 101 returns the processing to S622, and in a case where it is determined that the trailing edge of the sheet P passes through the upstream roller pair 21, the post-processing control unit advances the processing to S610. In S610, the post-processing control unit 101 calculates the rotation speed of the conveying motor 104 based on the average value of the plurality of latest cycles (for example, four cycles) among the rotation cycles of the plurality of downstream rollers 22*a* measured by the cycle sensor 131. In S611, the post-processing control unit 101 changes the rotation speed of the conveying motor 104 to the rotation speed calculated in S611. The flowchart of the speed adjustment of the second embodiment has been described above.

As described above, according to the second embodiment, the rotation cycles of the upstream roller 21*a* and the downstream roller 22*a* are measured, and the rotation speed of the conveying motor 104 is adjusted. As a result, even in a case where the diameters of the upstream roller 21*b* and the downstream roller 22*b* deviate from the ideal diameter, and the diameters thereof deviate from each other, it is possible to accurately punch the sheet P. As described above, based on the rotation cycle of the downstream roller 22*a* detected by the cycle sensor 131, the rotation speed of the conveying motor 104 is adjusted so that the circumferential speed of the downstream roller 22*b* substantially matches the speed component in the tangential direction at the punching position of the punch unit 62.

As described above, according to the second embodiment, in the post-processing apparatus including the punch unit for punching the sheet being conveyed, the holes can be punched at a predetermined position of the sheet regardless of the deviation in the diameter of the conveying roller.

Third Embodiment

In the first embodiment, the rotation speed of the conveying motor 104 changes as the countermeasure against the deviation in the diameter of the upstream roller 21*b*. In a third embodiment, a method of changing a drive start timing of a punching motor 102 and a rotation speed of a hole interval (corresponding to a non-punching section) based on a measured rotation cycle of an upstream roller 21*a* will be described. Specifically, a hole position 119 of a first hole is adjusted by changing a waiting time Tstop from when an inlet sensor 27 detects a leading edge of a sheet P to when the punching motor 102 is driven in FIG. 5 of the first embodiment. In addition, the hole interval is adjusted by changing a speed profile of the punching motor 102 from timing t9 when the punching of the first hole ends to timing t10 when the punching of the second hole starts. Similar to the first embodiment, the third embodiment describes a case where the upstream roller 21*b* and the downstream roller 22*b* have the same diameter deviation from the ideal diameter. In addition, since the configuration or function of the post-processing apparatus 4, the punching section, and the deviation in the roller diameter are similar to those of the first embodiment, the description thereof will be omitted.

Figure 10:
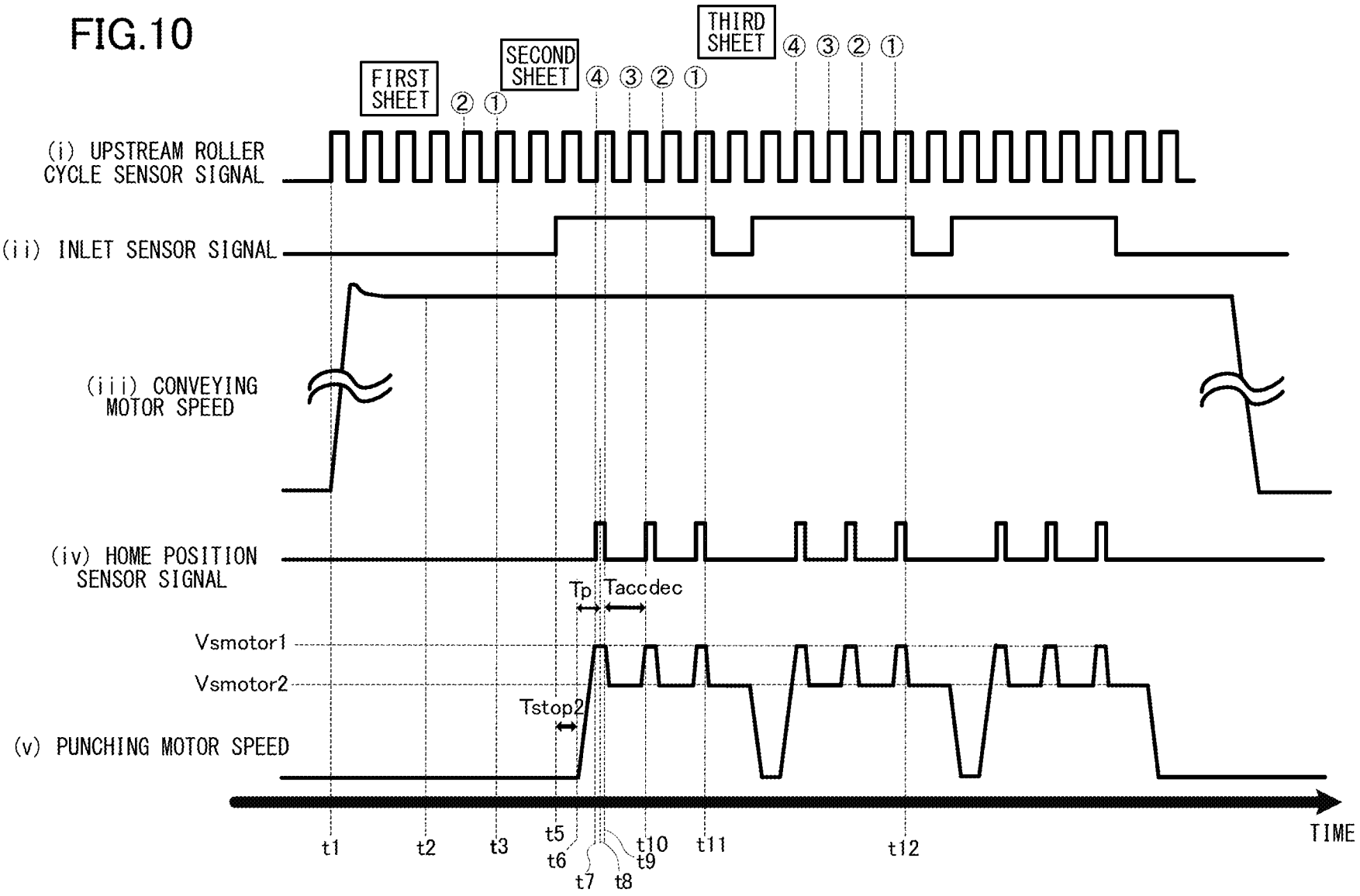
FIG. 10 is a diagram illustrating a sequence of each motor and each sensor according to a third embodiment.

Countermeasure Against Deviation in Diameter Between Upstream Roller and Downstream Roller Next, the countermeasure against the deviation in the diameters of the upstream roller 21*b* and the downstream roller 22*b* in the third embodiment will be described. FIGS. 10(*i*) to 10(*v*) are timing charts of rotation speeds of each motor and output signals of each sensor according to third embodiment, and FIGS. 10(*i*) to 10(*v*) are similar to FIGS. 5(*i*) to 5(*v*), and thus, description thereof will be omitted. In addition, since the meaning of each timing is the same as that in FIG. 5, the description thereof will be omitted.

At a timing t5 at which the inlet sensor 27 detects the leading edge of the sheet P, the sensor control unit 108 obtains a rotation cycle Tr2 of the upstream roller 21*a* as in the first embodiment. Here, the post-processing control unit 101 calculates an estimated conveyance speed Vs2 of the sheet P until the sheet P reaches a punching center position 75 after the inlet sensor 27 detects the leading edge of the sheet P. Here, a current rotation speed of the conveying motor 104 is Vsmotor1, an ideal rotation period is Tr1, the measured rotation period is Tr2, a reduction ratio of a drive gear connecting from the conveying motor 104 to the upstream roller pair 21 is Ks, and a radius of each roller of the upstream roller pair 21 is Rs. Using these, the estimated conveyance speed Vs2 is obtained by the following Equation (5).

$$Vs2=Rs\times 2\pi Vs\text{motor}1\times Ks\times Tr1/Tr2 \quad (5)$$

The estimated sheet conveyance time from a timing at which the inlet sensor 27 detects the leading edge of the sheet P to a timing t8 at which the punch 202 reaches the punching center position 75 is Ts2. The estimated sheet conveyance time Ts2 is obtained by the following Equation (6) using a distance L1 from the inlet sensor 27 to the punching center position 75, a distance L2 from the inlet sensor 27 to the center position of the first hole position 119, and the estimated conveyance speed Vs2 of the sheet P.

$$Ts2=(L1+L2)/Vs2 \quad (6)$$

The time during which the punch 202 and the die 205 rotate with a predetermined speed profile between FIGS. 3A and 3C is Tp. The time Tstop2 from when the inlet sensor 27 detects the leading edge of the sheet P to when the punching motor 102 is driven is obtained by Equation (7) using the estimated sheet conveyance time Ts2 obtained by Equation (6) and the time Tp.

$$Tstop2=Ts2-Tp \quad (7)$$

The motor control unit 105 waits for the time Tstop2 obtained by Equation (7) from the timing t5 at which the inlet sensor 27 detects the leading edge of the sheet P, and drives the punching motor 102 at the timing t6. The punching motor 102 can be driven with a speed profile targeting the rotation speed Vpmotor 1 in FIGS. 10 (*i*) to (*v*) to bring the hole position 119 of the first hole close to the ideal position with respect to the sheet P.

During a period from timing t9 at which the punching of the first hole ends to timing t10 at which the punching of the second hole starts, the post-processing control unit 101 causes the motor control unit 105 to perform acceleration/deceleration control of the punching motor 102. The time from the timing t9 to the timing t10 is an acceleration/deceleration time Taccdec. The acceleration/deceleration time Taccdec is obtained by Equation (8) from the estimated conveyance speed Vs2 of the sheet P obtained by Equation (5) and the distance L4 from the end (trailing edge) of the ideal hole to the end (leading edge) of the hole.

$$Taccdec=L4/Vs2 \quad (8)$$

Table 1 is a conversion table of the acceleration/deceleration time Taccdec of the punching motor 102 and the target speed Vpmotor 2. In Table 1, the acceleration/deceleration time Taccdec (msec) is indicated in the first column, and the target speed Vpmotor2 (pps) is indicated in the second column. The information in Table 1 is stored in, for example, a storage unit (not illustrated) included in the post-processing control unit 101.

TABLE 1

| Taccdec (msec) | Vpmotor2 (pps) |
|---|---|
| 302 | 698 |
| 306 | 691 |
| 309 | 684 |
| 312 | 677 |
| 315 | 671 |
| 318 | 664 |
| 321 | 658 |
| 325 | 652 |
| 328 | 646 |
| 331 | 640 |
| 334 | 634 |

The post-processing control unit 101 obtains the rotation speed Vpmotor2 as the target speed corresponding to the acceleration/deceleration time Taccdec using the conversion table of Table 1. For example, in a case where the acceleration/deceleration time Taccdec obtained by Equation (8) is 312 msec, the post-processing control unit 101 sets the target speed Vpmotor 2 to 677 pps from Table 1. In a case where the acceleration/deceleration time Taccdec is between the numerical values in the conversion table, for example, the target speed Vpmotor2 may be obtained by linear interpolation. The punching positions of the second and third holes can be brought close to the ideal position by driving the punching motor 102 with the speed profile in which the rotation speed Vpmotor 2 is set as the target speed.

At the timing t11 at which the third hole of the first sheet P has been punched, the sensor control unit 108 obtains the rotation period Tr2. Similarly, even in the second and succeeding sheets P, the rotation speed Vpmotor2 that is the target speed is obtained from the rotation period Tr2. Then, the sensor control unit 108 changes the rotation speed of the punching motor 102 from the timing at which the punching of the sheet P ends to the timing at which the punching of the sheet P starts to the rotation speed Vpmotor 2 which is the target speed. As a result, the same effect as that of the first sheet P can be obtained. The countermeasure against the deviation in the roller diameter of the upstream roller pair 21 and the roller diameter of the downstream roller pair 22 of the third embodiment has been described above.

Flowchart of Speed Adjustment of Third Embodiment

Figure 11:
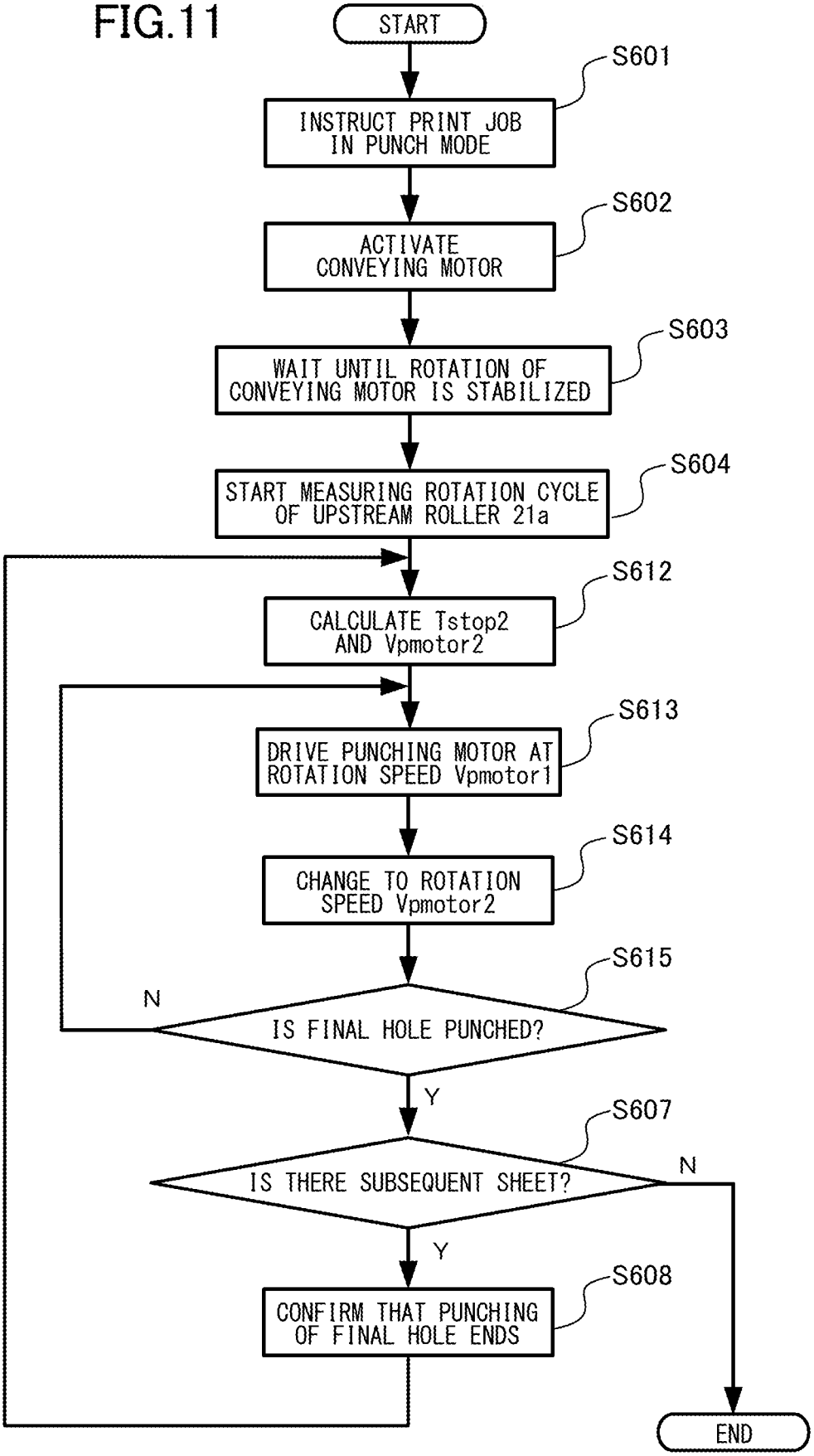
FIG. 11 is a flowchart illustrating a process of adjusting a rotation speed of a conveying motor according to the third embodiment.

According to the flowchart of FIG. 11, a series of flows for obtaining the waiting time Tstop2 and the rotation speed Vpmotor2 of the punching motor 102 from the rotation period Tr2 described above will be described with specific values. Processes similar to those in the first embodiment are denoted by the same step numbers, and the description thereof will be omitted.

After starting the measurement of the rotation cycle of the upstream roller 21*a* by the sensor control unit 108 in S604, the post-processing control unit 101 obtains the estimated conveyance speed Vs2 and the waiting time Tstop2 of the sheet P based on, for example, an average value of the latest four rotation cycles in S612. For example, in a case where Rs=10 [mm], Ks=0.3, Vsmotor1=1000 [rpm], Tr1=100 [msec], and Tr2=105 [msec] are substituted into Equation (5), the estimated conveyance speed Vs2 becomes 299 [mm/sec].

In addition, in a case where the distance L1 set to 20 [mm], the distance L2 set to 31.7 [mm], the obtained estimated conveyance speed Vs2, the distance L1, and the distance L2 are substituted into the Equation (6), the estimated sheet conveyance time Ts2=172.8 [msec] is obtained. In a case where the time Tp is set to 50 [msec], and the time Tp and the obtained estimated sheet conveyance time Ts2 are substituted into Equation (7), the waiting time Tstop2=122.8 [msec] is obtained.

In a case where the distance L4 is set to 100 [mm] and the distance L4 and the estimated conveyance speed Vs2 are substituted into the Equation (8), the acceleration/deceleration time Taccdec becomes 334 [msec]. In a case where the target speed Vpmotor2 corresponding to the acceleration/deceleration time Taccdec obtained from the conversion table of Table 1 is obtained, the rotation speed Vpmotor2 as the target speed becomes 634 [pps]. As described above, the post-processing control unit 101 calculates the waiting time Tstop2 and the rotation speed Vpmotor2 of the punching motor 102.

In S613, the post-processing control unit 101 refers to a timer (not illustrated) to wait for the waiting time Tstop2 (for example, 122.8 [msec]) obtained in S612 after the inlet sensor 27 detects the leading edge of the sheet P. Thereafter, the post-processing control unit 101 drives the punching motor 102 at the rotation speed Vpmotor 1 as the target speed. In a case where the punching ends in S614, the post-processing control unit 101 changes the target speed of the punching motor 102 to the rotation speed Vpmotor2 (for example, 634 [pps]) as the target speed obtained in S612. In S615, the post-processing control unit 101 determines whether or not a final hole has been punched on the sheet P. In a case where it is determined that the final hole has been punched in S615, the post-processing control unit 101 advances the processing to S607, and in a case where it is determined that the final hole has not been punched, the post-processing control unit returns the processing to S613. Note that, in a case where the processing of S608 ends, the post-processing control unit 101 returns the processing to S612. The flowchart of the speed adjustment of the third embodiment has been described above.

In the third embodiment, the post-processing control unit 101 performs adjustment as follows based on the rotation cycle of the upstream roller 21*a* detected by the cycle sensor 114. That is, the post-processing control unit 101 adjusts the timing to start driving the punching motor 102 and the rotation speed of the punching motor 102 between the predetermined punching operation and the punching operation performed subsequent to the predetermined punching operation (non-punching section). As described above, according to the third embodiment, in the post-processing apparatus including the punch unit for punching the sheet being conveyed, the holes can be punched at a predetermined position of the sheet regardless of the deviation in the diameter of the conveying roller. Note that the rotation speed adjustment of the punching motor 102 may be applied to the second embodiment. In addition, in the above-described embodiments, the first to fourth rotary members 21*a*, 21*b*, 22*a*, and 22*b* are configured by the rollers, but the present invention is not limited thereto, and for example, any one of the first to fourth rotary members may be configured by a belt or the like. Furthermore, the post-processing control unit 101 described above may be provided on either the post-processing apparatus 4 side or the image forming apparatus 1 side. In addition, in the embodiments described above, the post-processing apparatus 4 used in combination with the image forming apparatus 1 has been described as an example, but, for example, the invention according to the embodiments may be applied to a sheet processing apparatus used alone.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-032296, filed Mar. 2, 2021, which is hereby incorporated by reference herein in its entirety.

What is claimed is:

1. A processing apparatus processing on a sheet, the apparatus comprising:

a punch unit comprising a punch and being configured to punch a sheet being conveyed at a punching position while the punch is rotating;

a first motor configured to drive the punch unit;

a first rotary member disposed upstream of the punch unit in a conveyance direction of the sheet and configured to convey the sheet, the first rotary member comprising a roller;

a second motor configured to drive the first rotary member;

a control unit configured to control driving of the first motor and the second motor, the control unit comprising (a) circuitry, (b) a processor, or (c) circuitry and a processor; and a first detection unit comprising a sensor and being configured to detect a surface speed of the first rotary member, wherein the control unit is configured to adjust a rotation speed of the second motor so that a surface speed of the first rotary member obtained based on a detection result of the first detection unit substantially matches a tangential component of a rotation speed of the punch at the punching position.

2. The processing apparatus according to claim 1, further comprising:

a second detection unit comprising a sensor and being configured to detect presence or absence of the sheet, wherein the control unit is configured to adjust a rotation speed of the second motor before the second detection unit detects a leading edge of the sheet.

3. The processing apparatus according to claim 1, further comprising:

a third rotary member configured to be in contact with the first rotary member and to rotate the first rotary member, the third rotary member comprising a roller, wherein the first rotary member has a Young's modulus lower than that of the third rotary member, and wherein the first detection unit is configured to detect a rotation cycle of the third rotary member.

4. The processing apparatus according to claim 3, wherein the roller of the first rotary member is a rubber roller, and wherein the roller of the third rotary member is a resin roller.

5. The processing apparatus according to claim 1, wherein in a case where there is a succeeding sheet being continuously conveyed to the sheet, the control unit is configured to adjust a rotation speed of the second motor to convey the succeeding sheet by the first rotary member after a punching operation on the sheet by the punch unit is finished.

6. The processing apparatus according to claim 1, further comprising:

a second rotary member disposed downstream of the punch unit in the conveyance direction and configured to convey the sheet by being driven by the second motor, the second rotary member comprising a roller; and a third detection unit comprising a sensor and being configured to detect a surface speed of the second rotary member, wherein the control unit is configured to adjust the rotation speed of the second motor so that the surface speed of the second rotary member obtained based on a detection result of the third detection unit substantially matches a tangential component of the rotation speed of the punch at the punching position.

7. The processing apparatus according to claim 6, wherein the control unit is configured to adjust the rotation speed of the second motor after a trailing edge of the sheet passes through the first rotary member.

8. The processing apparatus according to claim 6, further comprising:

a fourth rotary member configured to be in contact with the second rotary member and rotate the second rotary member, the fourth rotary member comprising a roller, wherein the second rotary member has a Young's modulus lower than that of the fourth rotary member, and wherein the third detection unit is configured to detect a rotation cycle of the fourth rotary member.

9. The processing apparatus according to claim 8, wherein the roller of the second rotary member is a rubber roller, and wherein the roller of the fourth rotary member is a resin roller.

10. The processing apparatus according to claim 1, wherein the first motor is a stepping motor, and wherein the second motor is a DC brushless motor.

11. The processing apparatus according to claim 1, wherein the punch unit includes (a) the punch, which is driven by the first motor to rotate in a predetermined direction and which punches the sheet, and (b) a die that rotates in a direction opposite to the predetermined direction and that has a hole that meshes with the punch at the punching position.

12. An image forming system comprising:

an image forming unit configured to form an image on a sheet;

a punch unit comprising a punch and being configured to punch a sheet, on which an image is formed by the image forming unit at a punching position while the punch is rotating with respect to the sheet;

a first motor configured to drive the punch unit;

a first rotary member disposed upstream of the punch unit in a conveyance direction of the sheet and configured to convey the sheet, the first rotary member comprising a roller;

a second motor configured to drive the first rotary member;

a control unit configured to control driving of the first motor and the second motor, the control unit comprising (a) circuitry, (b) a processor, or (c) circuitry and a processor; and a first detection unit comprising a sensor and being configured to detect a surface speed of the first rotary member, wherein the control unit is configured to adjust a rotation speed of the second motor so that a surface speed of the first rotary member obtained based on a detection result of the first detection unit substantially matches a tangential component of a rotation speed of the punch at the punching position.

13. A processing apparatus processing on a sheet, the apparatus comprising:

a sheet processing unit configured to perform processing on a sheet;

a first rotary member disposed upstream of the sheet processing unit in a conveyance direction of the sheet and configured to convey the sheet to the sheet processing unit, the first rotary member comprising a roller;

a motor configured to drive the first rotary member;

a third rotary member comprising a roller and being configured to be in contact with the first rotary member and to rotate the first rotary member, the third rotary member having a Young's modulus higher than that of the first rotary member; and a first detection unit comprising a sensor and being configured to detect a rotation cycle of the third rotary member.

* * * * *